US010566740B2

(12) United States Patent
Trout et al.

(10) Patent No.: US 10,566,740 B2
(45) Date of Patent: Feb. 18, 2020

(54) SHIELDING STRUCTURE FOR A CONTACT MODULE OF AN ELECTRICAL CONNECTOR

(71) Applicant: TE CONNECTIVITY CORPORATION, Berwyn, PA (US)

(72) Inventors: David Allison Trout, Lancaster, PA (US); Justin Dennis Pickel, Hummelstown, PA (US); Jeffrey Byron McClinton, Harrisburg, PA (US); Timothy Robert Minnick, Enola, PA (US); Chad William Morgan, Carneys Point, NJ (US); John Joseph Consoli, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/180,199

(22) Filed: Nov. 5, 2018

(65) Prior Publication Data

US 2019/0305486 A1 Oct. 3, 2019

Related U.S. Application Data

(60) Provisional application No. 62/649,980, filed on Mar. 29, 2018.

(51) Int. Cl.

| | |
|---|---|
| ***H01R 13/648*** | (2006.01) |
| ***H01R 13/652*** | (2006.01) |
| ***H01R 13/6583*** | (2011.01) |
| ***H01R 13/6587*** | (2011.01) |
| ***H01R 13/6471*** | (2011.01) |

(52) U.S. Cl.
CPC ..... *H01R 13/652* (2013.01); *H01R 13/6471* (2013.01); *H01R 13/6583* (2013.01); *H01R 13/6587* (2013.01)

(58) Field of Classification Search
CPC ..... H01R 13/652; H01R 13/6471; H01R 13/6583; H01R 13/6587
USPC ..... 439/607.05, 607.08, 607.09, 607.28
See application file for complete search history.

(56) References Cited

U.S. PATENT DOCUMENTS

| | | | |
|---|---|---|---|
| 5,620,340 | A | 4/1997 | Andrews |
| 6,347,962 | B1 | 2/2002 | Kline |
| 6,520,803 | B1 | 2/2003 | Dunn |

(Continued)

OTHER PUBLICATIONS

U.S. Appl. No. 16/180,248, filed Nov. 5, 2018.
U.S. Appl. No. 16/180,226, filed Nov. 5, 2018.

*Primary Examiner* — Khiem M Nguyen

(57) ABSTRACT

A contact module includes a dielectric holder holding signal contacts having mating portions extending forward of the dielectric holder. A shield structure is coupled to the dielectric holder providing electrical shielding for the signal contacts. The shield structure has first and second ground shields having corresponding mating portions extending forward of the mating end of the dielectric holder. The shield structure has ground blades extending between the first and second ground shields having mating portions extending forward of the mating end of the dielectric holder at least one of above or below the mating portions of the signal contacts. The ground blades electrically connect the mating portions of the first ground shield and the mating portions of the second ground shield immediately forward of the mating end of dielectric holder.

20 Claims, 11 Drawing Sheets

(56) References Cited

U.S. PATENT DOCUMENTS

| | | | | |
|---|---|---|---|---|
| 8,398,431 | B1 | 3/2013 | Whiteman, Jr. et al. | |
| 8,398,432 | B1 | 3/2013 | McClellan et al. | |
| 8,475,209 | B1 | 7/2013 | Whiteman, Jr. et al. | |
| 8,591,260 | B2 | 11/2013 | Davis | |
| 9,356,401 | B1 | 5/2016 | Horning et al. | |
| 9,407,045 | B2 | 8/2016 | Horning et al. | |
| 9,608,382 | B2 | 3/2017 | McClellan et al. | |
| 9,748,698 | B1 | 8/2017 | Morgan et al. | |
| 9,859,640 | B1 | 1/2018 | Horning et al. | |
| 9,917,406 | B1 | 3/2018 | Iwasaki et al. | |
| 9,985,389 | B1 * | 5/2018 | Morgan | H01R 13/6587 |
| 10,148,025 | B1 | 12/2018 | Trout et al. | |
| 10,186,811 | B1 * | 1/2019 | Trout | H01R 13/6588 |
| 2003/0186594 | A1 | 10/2003 | Davis et al. | |
| 2009/0227141 | A1 | 9/2009 | Pan | |
| 2010/0144176 | A1 | 6/2010 | Fedder et al. | |
| 2010/0227503 | A1 | 9/2010 | Liu et al. | |
| 2014/0148054 | A1 | 5/2014 | Annis et al. | |
| 2015/0303618 | A1 | 10/2015 | Lee et al. | |
| 2018/0219329 | A1 | 8/2018 | Morgan et al. | |
| 2018/0219330 | A1 | 8/2018 | Morgan et al. | |

* cited by examiner

SHIELDING STRUCTURE FOR A CONTACT MODULE OF AN ELECTRICAL CONNECTOR

CROSS REFERENCE TO RELATED APPLICATIONS

This application claims benefit to U.S. Provisional Application No. 62/649,980, filed Mar. 29, 2018, titled "SHIELDING STRUCTURE FOR A CONTACT MODULE OF AN ELECTRICAL CONNECTOR", the subject matter of which is herein incorporated by reference in its entirety.

BACKGROUND OF THE INVENTION

The subject matter herein relates generally to shielding structures for contact modules of electrical connectors.

Some electrical systems utilize electrical connectors, such as header assemblies and receptacle assemblies, to interconnect two circuit boards, such as a motherboard and daughtercard. Some known electrical connectors include a front housing holding a plurality of contact modules arranged in a contact module stack. The electrical connectors provide electrical shielding for the signal conductors of the contact modules. For example, ground shields may be provided on one or both sides of each contact module. However, at high speeds, the electrical shielding of known electrical connectors may be insufficient. For example, shielding at the mating interface between the header and receptacle assemblies is difficult. Additionally, while the ground shield(s) may provide shielding along the sides of the signal conductors, known electrical connectors do not provide sufficient additional electrical shielding above and/or below the signal conductors throughout the length of the contact modules. For example, the additional electrical shielding may only be provided at the mating interface with the mating electrical connector and not along the length of the signal conductors between the mating end and the mounting end mounted to the circuit board.

Furthermore, for contact modules that provide pairs of signal conductors arranged in the same row, rather than the same column, shielding between the pairs of signal conductors is difficult and/or expensive. For example, some known electrical connectors provide contact modules with conductive shells that provide some additional shielding. However, the shells are plated plastic or die cast shells that can add significant cost to the contact modules.

A need remains for a shielding structure for contact modules along significant lengths of the signal contacts thereof to provide electrical shielding between pairs of the signal contacts.

BRIEF DESCRIPTION OF THE INVENTION

In one embodiment, a contact module is provided including a dielectric holder having first and second sides extending between a mating end at a front of the dielectric holder and a mounting end. Signal contacts are held by the dielectric holder having mating portions extending forward of the mating end, mounting portions extending from the mounting end for termination to a circuit board, and transition portions extending through the dielectric holder between the mating portion and the mounting portion. A shield structure is coupled to the dielectric holder providing electrical shielding for the signal contacts. The shield structure has a first ground shield provided at the first side of the dielectric holder and a second ground shield provided at the second side of the dielectric holder. The first ground shield has mating portions extending forward of the mating end of the dielectric holder along first sides of the mating portions of the signal contacts and providing electrical shielding for the mating portions of the signal contacts and the second ground shield has mating portions extending forward of the mating end of the dielectric holder along second sides of the mating portions of the signal contacts and providing electrical shielding for the mating portions of the signal contacts. The shield structure has ground blades extending between the first and second ground shields having mating portions extending forward of the mating end of the dielectric holder at least one of above or below the mating portions of the signal contacts. The ground blades electrically connect the mating portions of the first ground shield and the mating portions of the second ground shield immediately forward of the mating end of dielectric holder.

In another embodiment, a shield structure is provided for a contact module having a dielectric holder holding signal contacts arranged in pairs carrying differential signals, the signal contacts having mating portions extending forward of the dielectric holder for mating with a mating electrical connector. The shield structure includes a first ground shield having a main body configured to extend along a first side of the dielectric holder having a plurality of rails separated by gaps. The rails have side strips configured to extend along the first side of the dielectric holder and connecting strips configured to extend into the dielectric holder. Each rail has a mating portion extending from the main body forward of the dielectric holder for providing electrical shielding for the mating portions of the corresponding signal contacts. The shield structure includes a second ground shield having a main body configured to extend along a second side of the dielectric holder having a plurality of rails separated by gaps. The rails have side strips configured to extend along the second side of the dielectric holder and connecting strips configured to extend into the dielectric holder. Each rail has a mating portion extending from the main body forward of the dielectric holder for providing electrical shielding for the mating portions of the corresponding signal contacts. The shield structure includes ground blades configured to at least partially cover a mating end of the dielectric holder. The ground blades extend between the first and second ground shields. The ground blades have mating portions extending forward of the dielectric holder at least one of above or below the mating portions of the signal contacts. The ground blades electrically connect the mating portions of the first ground shield and the mating portions of the second ground shield immediately forward of the mating end of dielectric holder.

In a further embodiment, an electrical connector is provided including a housing having a mating end and contact modules arranged in a contact module stack received in and extending from the housing for termination to a circuit board. Each contact module includes dielectric holder having first and second sides extending between a mating end at a front of the dielectric holder and a mounting end. Signal contacts are held by the dielectric holder having mating portions extending forward of the mating end, mounting portions extending from the mounting end for termination to a circuit board, and transition portions extending through the dielectric holder between the mating portion and the mounting portion. A shield structure is coupled to the dielectric holder providing electrical shielding for the signal contacts. The shield structure has a first ground shield provided at the first side of the dielectric holder and a second ground shield provided at the second side of the dielectric holder. The first ground shield has mating portions extending forward of the mating end of the dielectric holder along first sides of the mating portions of the signal contacts and providing electrical shielding for the mating portions of the signal contacts and the second ground shield has mating portions extending forward of the mating end of the dielectric holder along second sides of the mating portions of the signal contacts and providing electrical shielding for the mating portions of the signal contacts. The shield structure has ground blades extending across each of the contact modules to electrically connect the first and second ground shields of each of the contact modules. The ground blades have mating portions extending forward of the mating end of the dielectric holder at least one of above or below the mating portions of the signal contacts. The ground blades electrically connect the mating portions of the first ground shield and the mating portions of the second ground shield immediately forward of the mating end of dielectric holder.

DETAILED DESCRIPTION OF THE INVENTION

Figure 1:
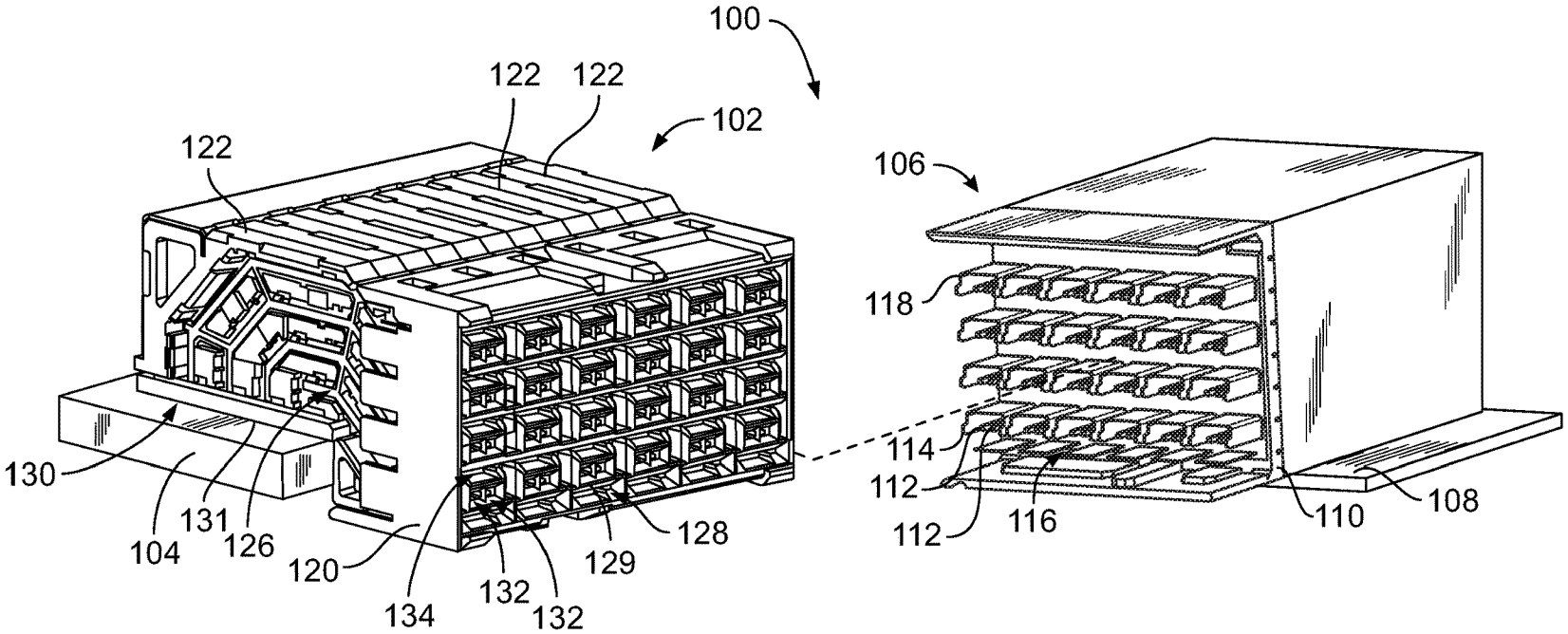
FIG. 1 is a front perspective view of an electrical connector system formed in accordance with an exemplary embodiment.

FIG. 1 is a front perspective view of an electrical connector system 100 formed in accordance with an exemplary embodiment. The connector system 100 includes an electrical connector 102 configured to be mounted to a circuit board 104 and a mating electrical connector 106, which may be mounted to a circuit board 108. The mating electrical connector 106 may be a header connector. Various types of connector assemblies may be used in various embodiments, such as a right angle connector, a vertical connector or another type of connector.

The mating electrical connector 106 includes a housing 110 holding a plurality of mating signal contacts 112 and mating ground shields 114. The mating signal contacts 112 may be arranged in pairs 116. Each mating ground shield 114 extends around corresponding mating signal contacts 112, such as the pairs 116 of mating signal contacts 112. In the illustrated embodiment, the mating ground shields 114 are C-shaped having three walls extending along three sides of each pair of mating signal contacts 112. The mating ground shield 114 adjacent to the pair 116 provides electrical shielding along a fourth side of the pair 116. As such, the pairs 116 of mating signal contacts 112 are circumferentially surrounded on all four sides by the mating ground shields 114. The mating ground shields 114 may have other shapes in alternative embodiments. The mating ground shields 114 extend to edges 118.

The electrical connector 102 includes a housing 120 that holds a plurality of contact modules 122. The contact modules 122 are held in a stacked configuration generally parallel to one another. The contact modules 122 may be loaded into the housing 120 side-by-side in the stacked configuration as a unit or group. Any number of contact modules 122 may be provided in the electrical connector 102. The contact modules 122 each include a plurality of signal contacts 124 (shown in FIG. 2) that define signal paths through the electrical connector 102. The signal contacts 124 are configured to be electrically connected to corresponding mating signal contacts 112 of the mating electrical connector 106.

The electrical connector 102 includes a mating end 128, such as at a front 129 of the electrical connector 102, and a mounting end 130, such as at a bottom 131 of the electrical connector 102. In the illustrated embodiment, the mounting end 130 is oriented substantially perpendicular to the mating end 128. The mating and mounting ends 128, 130 may be at different locations other than the front 129 and bottom 131 in alternative embodiments. The signal contacts 124 extend through the electrical connector 102 from the mating end 128 to the mounting end 130 for mounting to the circuit board 104.

Figure 13:
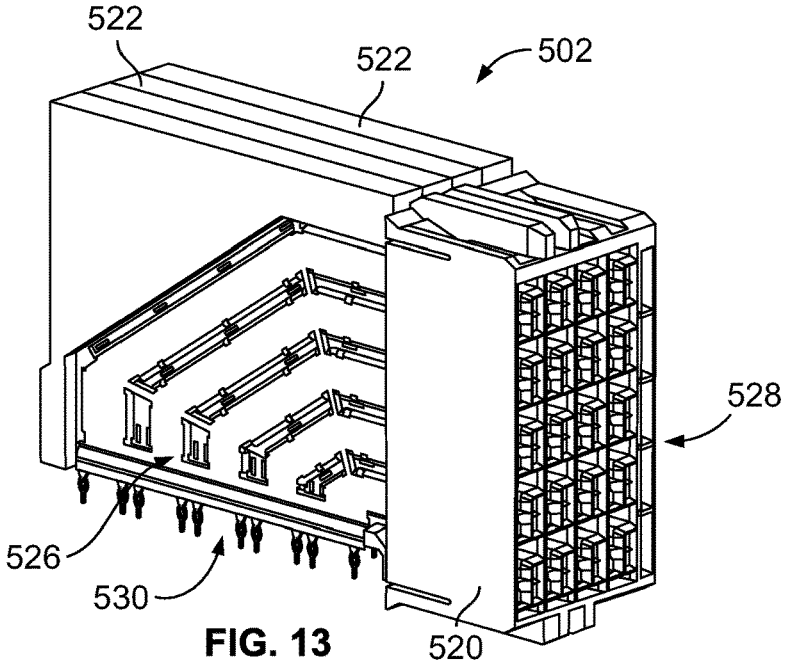
FIG. 13 is a front perspective view of an electrical connector in accordance with an exemplary embodiment.

The signal contacts 124 are received in the housing 120 and held therein at the mating end 128 for electrical termination to the mating electrical connector 106. The signal contacts 124 are arranged in a matrix of rows and columns. In the illustrated embodiment, at the mating end 128, the rows are oriented horizontally and the columns are oriented vertically. Other orientations are possible in alternative embodiments. Any number of signal contacts 124 may be provided in the rows and columns. Optionally, the signal contacts 124 may be arranged in pairs carrying differential signals; however other signal arrangements are possible in alternative embodiments, such as single-ended applications. Optionally, the pairs of signal contacts 124 may be arranged in rows (pair-in-row signal contacts); however, the pairs of signal contacts may be arranged in columns (pair-in-column signal contacts, for example, as shown in FIG. 13) in alternative embodiments. In an exemplary embodiment, the signal contacts 124 within each pair are contained within the same contact module 122.

In an exemplary embodiment, each contact module 122 has a shield structure 126 for providing electrical shielding for the signal contacts 124. The shield structure 126 is configured to be electrically connected to the mating ground shields 114 of the mating electrical connector 106. The shield structure 126 may provide shielding from electromagnetic interference (EMI) and/or radio frequency interference (RFI), and may provide shielding from other types of interference as well to better control electrical characteristics, such as impedance, cross-talk, and the like, of the signal contacts 124. The contact modules 122 provide shielding for each pair of signal contacts 124 along substantially the entire length of the signal contacts 124 between the mating end 128 and the mounting end 130. In an exemplary embodiment, the shield structure 126 is configured to be electrically connected to the mating electrical connector 106 and/or the circuit board 104. The shield structure 126 may be electrically connected to the circuit board 104 by features, such as grounding pins and/or surface tabs.

The housing 120 includes a plurality of signal contact openings 132 and a plurality of ground contact openings 134 at the mating end 128. The signal contacts 124 are received in corresponding signal contact openings 132. Optionally, a single signal contact 124 is received in each signal contact opening 132. The signal contact openings 132 may also receive corresponding mating signal contacts 112 of the mating electrical connector 106. In the illustrated embodiment, the ground contact openings 134 are C-shaped extending along three sides of the corresponding pair of signal contact openings 132. The ground contact openings 134 receive mating ground shields 114 of the mating electrical connector 106. The ground contact openings 134 also receive portions of the shield structure 126 (for example, beams and/or fingers) of the contact modules 122 that mate with the mating ground shields 114 to electrically common the shield structure 126 with the mating electrical connector 106.

The housing 120 is manufactured from a dielectric material, such as a plastic material, and provides isolation between the signal contact openings 132 and the ground contact openings 134. The housing 120 isolates the signal contacts 124 from the shield structure 126. The housing 120 isolates each set (for example, differential pair) of signal contacts 124 from other sets of signal contacts 124.

Figure 2:
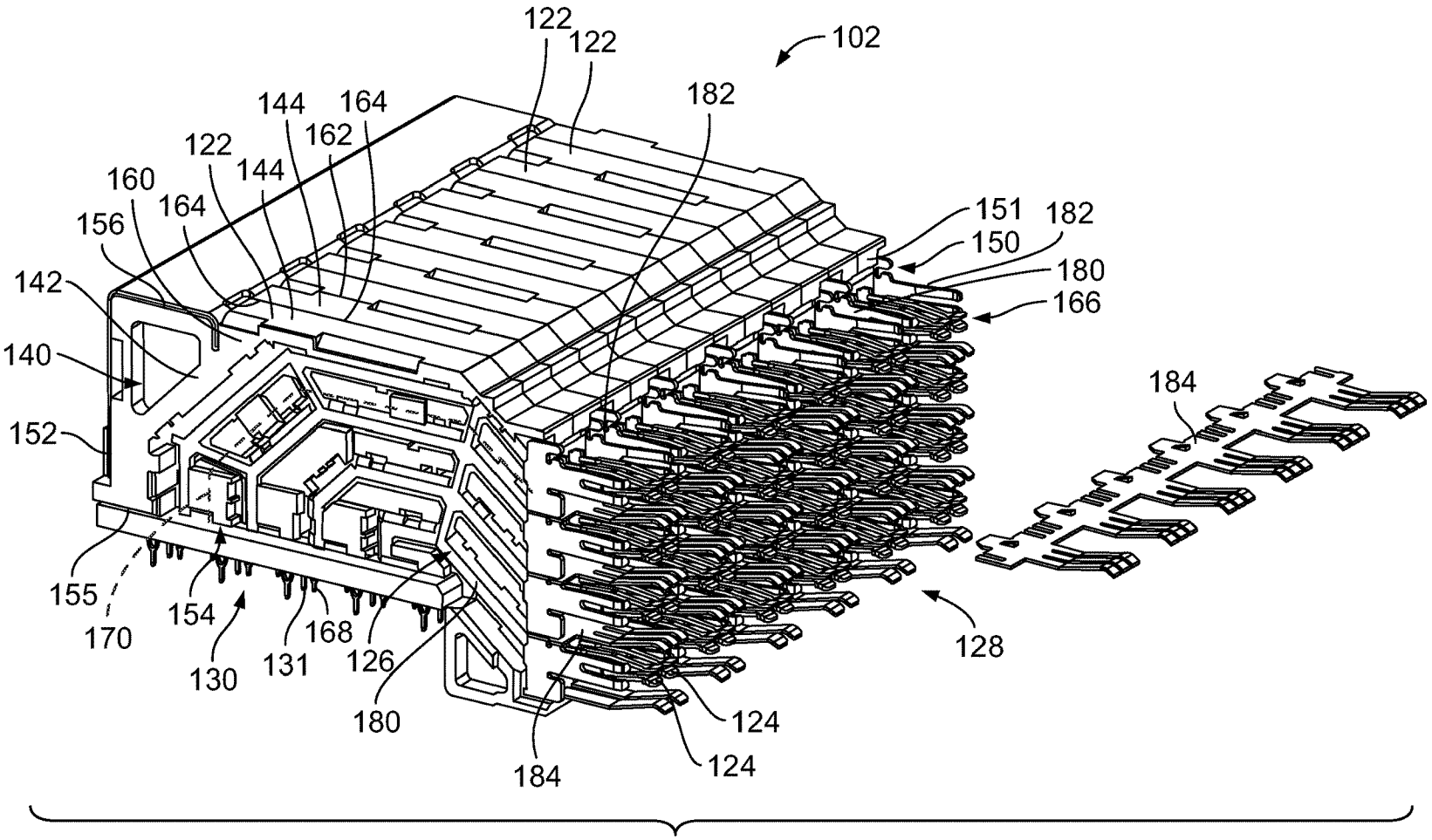
FIG. 2 is a partially exploded view of a portion of an electrical connector of the electrical connector system in accordance with an exemplary embodiment.

FIG. 2 is a partially exploded view of a portion of the electrical connector 102 with the housing 120 removed to illustrate the contact modules 122 in accordance with an exemplary embodiment. Each contact module 122 includes a frame assembly 140 having an array of the signal contacts 124 and a dielectric holder 142 holding the signal contacts 124. The dielectric holder 142 generally surrounds the signal contacts 124 along substantially the entire length of the signal contacts 124 between the mounting end 130 at the bottom 131 and the mating end 128 at the front 129. The shield structure 126 is coupled to the dielectric holder 142 to provide electrical shielding for the signal contacts 124, such as for each pair of the signal contacts 124. The shield structure 126 provides circumferential shielding for each pair of signal contacts 124 along at least a majority of a length of the signal contacts 124, such as substantially an entire length of the signal contacts 124.

In an exemplary embodiment, the frame assembly 140 is assembled together from two contact sub-assemblies. For example, the dielectric holder 142 may be a two-piece holder formed from two dielectric bodies 144 arranged side-by-side. Each dielectric body 144 surrounds a corresponding array of signal contacts 124. The dielectric body 144 may be overmolded over the signal contacts 124 (for example, each dielectric body 144 may be overmolded over a set of the signal contacts 124 to form one of the contact sub-assemblies). Optionally, the signal contacts 124 may be initially formed from a leadframe and overmolded by the corresponding dielectric body 144 such that portions of the signal contacts 124 are encased in the dielectric holder 142.

The dielectric holder 142 has a mating end 150 at a front 151 thereof configured to be loaded into the housing 120 (shown in FIG. 1), a rear 152 opposite the mating end 150, a mounting end 154 at a bottom 155 which optionally may be adjacent to the circuit board 104 (shown in FIG. 1), and a top 156 generally opposite the mounting end 154. The dielectric holder 142 also includes first and second sides, such as a right side 160 and a left side 162. The shield structure 126 is coupled to both the right and left sides 160, 162. The dielectric bodies 144 include respective interior sides 164 facing and abutting each other. Each dielectric body 144 holds one of the signal contacts 124 from each pair such that the pair has signal contacts 124 in both contact sub-assemblies. When assembled, the signal contacts 124 in each pair are aligned with each other and follow similar paths between the mating and mounting ends 128, 130. For example, the signal contacts 124 have similar shapes and thus have similar lengths, which reduces or eliminates skew in the signal paths for the pairs. The pair-in-row arrangement may enhance the electrical performance of the contact module 122 as compared to pair-in-column contact modules having the signal contacts of each pair radially offset from each other (for example, one radially inside and the other radially outside), leading to skew problems.

The signal contacts 124 may be stamped and formed from a sheet of metal material. Each signal contact 124 has a mating portion 166 extending forward from the mating end 150 of the dielectric holder 142 and a mounting portion 168 extending downward from the mounting end 154. The mating and mounting portions 166, 168 are exposed beyond the front 151 and the bottom 155, respectively, of the dielectric holder 142. Each signal contact 124 has a transition portion 170 (one of which is shown in phantom in FIG. 2) between the mating and mounting portions 166, 168. The transition portions 170 each include a top, a bottom, a right side, and a left side (the right and left sides define corresponding inner and outer sides for the left and right contact sub-assemblies. In an exemplary embodiment, the top, bottom, and corresponding outer side are each configured to be shielded by the shield structure 126. The inner sides (right side or left side) face each other along the lengths of the transition portions 170. The mating portions 166 are configured to be electrically terminated to corresponding mating signal contacts 112 (shown in FIG. 1) when the electrical connector 102 is mated to the mating electrical connector 106 (shown in FIG. 1). In an exemplary embodiment, the mounting portions 168 include compliant pins, such as eye-of-the-needle pins, configured to be terminated to the circuit board 104 (shown in FIG. 1).

In an exemplary embodiment, the shield structure 126 includes first and second ground shields 180, 182 and ground blades 184 extending between and configured to be electrically connected to the first and second ground shields 180, 182. Each ground blade 184 is configured to be assembled with the dielectric holder 142, such as immediately forward of the mating end 150 of the dielectric holder 142. The ground blade 184 may be attached to the electric holder 142 at the mating end 150. In an exemplary embodiment, the ground blades 184 span or cover the mating ends 150 of each of the dielectric holders 142. The ground blades 184 are oriented horizontally along the front 129 of the electrical connector 102. The ground blades 184 are positioned adjacent to the mating zone between the signal contacts 124 and the mating signal contacts 112 (FIG. 1). The ground blades 184 are configured to be electrically connected to the first and second ground shields 180, 182 of each contact module 122 such that the ground shields 180, 182 are electrically commoned adjacent to the mating zone. Optionally, the ground blades 184 may be used to mechanically secure the first ground shield 180 and/or the second ground shield 182 to the contact module 122. The ground blades 184 provide electrical shielding for the signal contacts 124 at the exit/entrance points of the signal contacts 124 from the dielectric holder 142. The ground blades 184 provide electrical shielding for the mating portions 166 of the signal contacts 124 adjacent to the mating zone.

In an exemplary embodiment, the ground blades 184 are provided above and/or below each of the mating portions 166 of the pairs of signal contacts 124 to provide electrical shielding between the pairs of signal contacts 124 within the same contact module 122. The first and second ground shields 180, 182 are provided along right and left sides of each of the mating portions 166 of the pairs of signal contacts 124 to provide electrical shielding between the pairs of signal contacts 124 in adjacent contact modules 122. In an exemplary embodiment, the ground blades 184 and the first and second ground shields 180, 182 form shield pockets around each pair of signal contacts 124 to shield such pair from adjacent pairs in the same column and in the same row. In an exemplary embodiment, the ground blades 184 and the first and second ground shields 180, 182 extend across the fronts 151 of the dielectric holders 142 to provide shielding for the mating portions 166 and the transition portions 170 of the signal contacts 124.

The first and second ground shields 180, 182 cooperate to provide circumferential shielding for each pair of signal contacts 124 along the length thereof. The first ground shield 180 is positioned along the right side 160 of the dielectric holder 142, and as such, may be hereinafter referred to as the right ground shield 180. The second ground shield 182 is positioned along the left side 162 of the dielectric holder 142, and may be hereinafter referred to as the left ground shield 182. The first and second ground shields 180, 182 and the ground blades 184 electrically connect the contact module 122 to the mating electrical connector 106, such as to the mating ground shields 114 thereof (shown in FIG. 1), thereby providing an electrically common ground path between the electrical connector 102 and the mating electrical connector 106. The first and second ground shields 180, 182 electrically connect the contact module 122 to the circuit board 104, such as through compliant pins thereof. The first and second ground shields 180, 182 may be similar and include similar features and components. As such, the description below may include description of either ground shield, which may be relevant to the other ground shield, and like components may be identified with like reference numerals.

Figure 3:
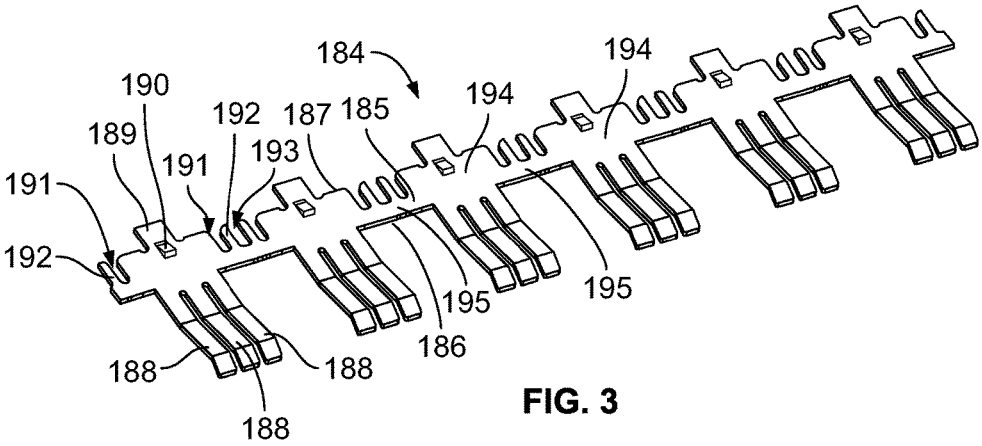
FIG. 3 is a perspective view of a ground blade of the electrical connector in accordance with an exemplary embodiment.

FIG. 3 is a perspective view of the ground blade 184 in accordance with an exemplary embodiment. The ground blade 184 includes a main body 185 having a front 186 and a rear 187. The ground blade 184 includes a plurality of mating portions 188 extending forward from the front 186. In the illustrated embodiment, the mating portions 188 are arranged in sets, with each set configured to mate with a corresponding mating ground shield 114 (shown in FIG. 1). Each set includes a plurality of mating portions 188, thus defining multiple points of contact with the mating ground shield 114. The mating portions 188 are deflectable mating beams configured to be spring biased against the mating ground shield 114 when mated thereto to create a mechanical and electrical connection with the mating ground shield 114. Optionally, the mating portions 188 are configured to be received inside the corresponding C-shaped mating ground shields 114 of the mating electrical connector 106. Alternatively, the mating portions 188 are configured to extend along the outside of the corresponding C-shaped mating ground shields 114 of the mating electrical connector.

The ground blade 184 includes a mounting tab 189 extending from the rear 187. The mounting tab 189 is used for mounting the ground blade 184 to the dielectric holder 142 (shown in FIG. 2). In an exemplary embodiment, the mounting tab 189 may define a point of contact with the first ground shield 180 and/or the second ground shield 182 (both shown in FIG. 2), as described in further detail below. In an exemplary embodiment, the ground blade 184 includes a securing feature 190 for securing the ground blade 184 to the dielectric holder 142. In the illustrated embodiment, the securing feature 190 is a lance or barb configured to engage the dielectric holder 142 when loaded into the front 151 of the dielectric holder 142. The securing feature 190 may dig into the plastic of the dielectric holder 142 to resist removal of the ground blade 184 from the dielectric holder 142. In other various embodiments, the securing feature 190 may be a dimple or embossment configured to create an interference fit with the dielectric holder 142.

The ground blade 184 includes slots 191 that receive the first and second ground shields 180, 182 during mating thereto. In an exemplary embodiment, the ground blade 184 includes a mating finger 192 extending along the slot 191. The mating finger 192 is configured to be mated to the corresponding ground shield 180, 182. Optionally, the mating finger 192 may be deflectable. The mating finger 192 may include a bulge or protrusion extending into the slot 191 that defines a mating interface for mating with the corresponding ground shield 180, 182. In an exemplary embodiment, the ground blade 184 includes a relief slot 193 adjacent to the corresponding mating finger 192 that provides a relief space to allow deflection of the mating finger 192 when mating with the ground shield 180, 182.

In an exemplary embodiment, the main body 185 of the ground blade 184 includes pads 194 connected by connecting segments 195. The mating portions 188 extend forward from the pads 194. The mounting tabs 189 extend rearward from the pads 194. The slots 191 and the mating fingers 192 are provided along the connecting segments 195. The pads 194 are configured to be located above and below the mating portions 166 of the signal contacts 124 and provide continuous shielding above and below the mating portions 166 between the first and second ground shields 180, 182.

Figure 4:
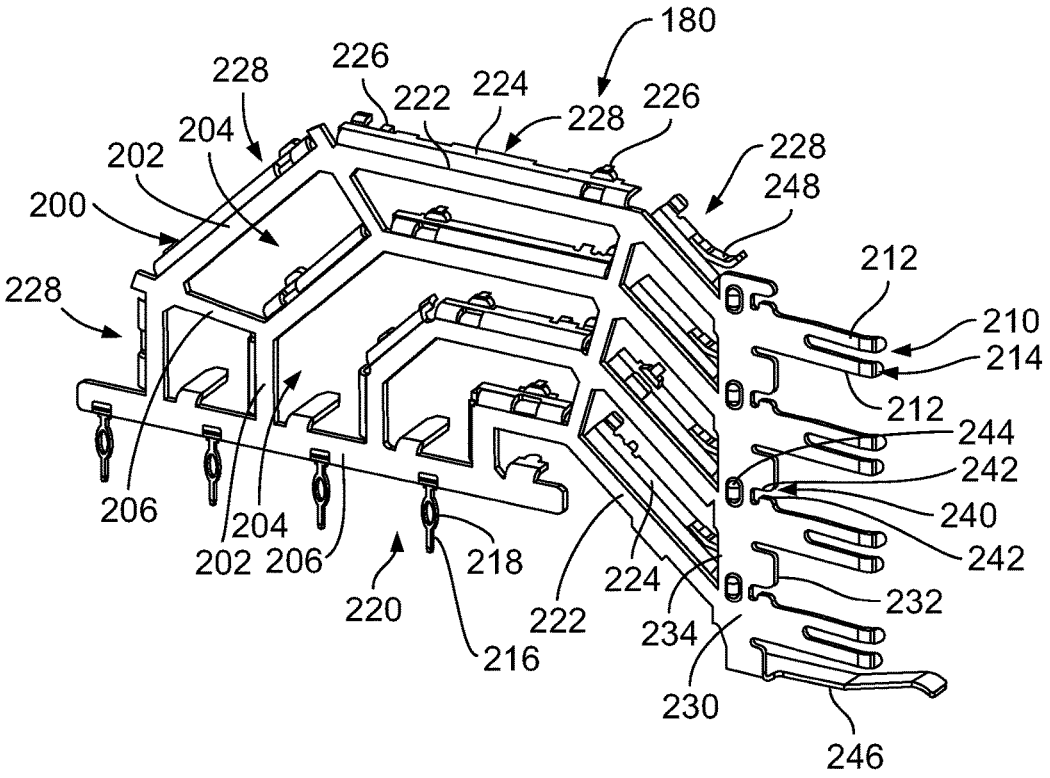
FIG. 4 is a perspective view of a ground shield of the electrical connector in accordance with an exemplary embodiment.

FIG. 4 is a perspective view of the first ground shield 180 in accordance with an exemplary embodiment. In an exemplary embodiment, the first ground shield 180 is stamped and formed from a stock piece of metal material. The first ground shield 180 includes a main body 200 configured to extend along the right side 160 of the dielectric holder 142 (both shown in FIG. 2). The main body 200 includes a plurality of right side rails 202 separated by right side gaps 204. The right side rails 202 are interconnected by struts 206 that span the gaps 204 between the right side rails 202.

The first ground shield 180 includes mating portions 210 defined by mating beams 212 at a mating end 214 of the main body 200. The mating portions 210 are configured to be mated with corresponding mating portions of the mating electrical connector 106 (for example, the C-shaped mating ground shields 114, shown in FIG. 1). In an exemplary embodiment, the mating portions 210 are bifurcated including multiple mating beams 212 associated with each corresponding signal contact 124. The mating beams 212 may be deflectable mating beams, such as spring beams. Optionally, the mating beams 212 are configured to be received inside the corresponding C-shaped mating ground shields 114 of the mating electrical connector 106. Alternatively, the mating beams 212 are configured to extend along the outside of the corresponding C-shaped mating ground shields 114 of the mating electrical connector.

The first ground shield 180 includes mounting portions 216 defined by compliant pins 218 at a mounting end 220 of the main body 200. The mounting portions 216 are configured to be terminated to the circuit board 104 (shown in FIG. 1). For example, the mounting portions 216 are configured to be received in plated vias in the circuit board 104.

The right side rails 202 are configured to provide shielding around corresponding signal contacts 124 (shown in FIG. 2). For example, in an exemplary embodiment, the right side rails 202 have side strips 222 configured to extend along the right side 160 of the dielectric holder 142, and connecting strips 224 configured to extend into the dielectric holder 142 and extend between adjacent signal contacts 124. The connecting strips 224 are bent perpendicular to and extend from the corresponding side strips 222. The right side rails 202 form right angle shielded spaces that receive corresponding signal contacts 124 to provide electrical shielding along the sides of the signal contacts 124 and between the signal contacts 124, such as above and/or below corresponding signal contacts 124. The struts 206 interconnect the right side rails 202 to hold the relative positions of the right side rails 202. The gaps 204 are defined between the right side rails 202 and generally follow the paths of the right side rails 202.

In an exemplary embodiment, each connecting strip 224 includes a commoning feature 226 for electrically connecting to the second ground shield 182 (shown in FIG. 2). In the illustrated embodiment, the commoning features 226 are commoning tabs that extend outward from the connecting strips 224 and commoning slots; however, other types of commoning features may be used in alternative embodiments, such as channels, spring beams, and the like. The commoning features 226 may be deflectable to engage and securely couple the first ground shield 180 to the second ground shield 182 when mated thereto. For example, the commoning features 226 may be clips.

The right side rails 202 are configured to extend along and follow the paths of the signal contacts 124, such as between the mating end 128 and the mounting end 130 (both shown in FIG. 1) of the electrical connector 102. For example, the right side rails 202 may transition from the mating end 214 to the mounting end 220 and have different segments or portions 228 that are angled relative to each other as the right side rails 202 transition between the mating and mounting ends 214, 220.

In an exemplary embodiment, the first ground shield 180 includes a first side plate 230 forward of the right side rails 202. The mating portions 210 extend from the first side plate 230. The first side plate 230 is continuous top to bottom and holds the positions of the right side rails 202 with the struts 206. The first side plate 230 forms continuous shielding along the right sides of the signal contacts 124. The first side plate 230 extends between a front 232 and a rear 234. The mating portions 210 extend forward from the front 232. The right side rails 202 extend from the rear 234. Optionally, the first side plate 230 may be out of plane with the right side rails 202, such as outward of the side strips 222 and the connecting strips 224.

The first side plate 230 includes slots 240 having guide features 242. The slots 240 receive corresponding ground blades 184 (shown in FIG. 2). The guide features 242 engage the ground blades 184 to locate the ground blades 184 relative to the first ground shield 180. For example, the guide features 242 may vertically positioned in the ground blade 184 in the slot 240. In an exemplary embodiment, the guide features 242 are defined by edges of the slot 240. The guide features 242 may include protrusions or tabs positioned in the slot 240 for locating the ground blade 184.

The first side plate 230 includes embossments 244 that extend outward therefrom. The embossments 244 are configured to engage the ground blades 184. The embossments 244 define points of contact with the ground blades 184. The embossments 244 may engage the ground blades 184 by an interference fit. For example, the mating fingers 192 (shown in FIG. 3) may engage the embossments 244 to mechanically and electrically connect the ground blades 184 to the first side plate 230.

The first ground shield 180 includes a lower ground beam 246 at the bottom of the first side plate 230. The lower ground beam 246 is bent perpendicular to the first side plate 230. The lower ground beam 246 is configured to be located below the mating portions 166 of the signal contacts 124 to provide electrical shielding below the bottom signal contact 124. The lower ground beam 246 may be electrically connected to the mating electrical connector 106 when mated thereto.

In an exemplary embodiment, the first ground shield 180 includes commoning features 248 extending from the right side rails 202. The commoning features 248 are configured to electrically engage the ground blades 184. In the illustrated embodiment, the commoning features 248 are deflectable spring beams extending from the front ends of the connecting strips 224. The commoning features 248 are configured to electrically connect to the mounting tabs 189 of the ground blades 184 to electrically common the first ground shield 180 and the ground blades 184.

Figure 5:
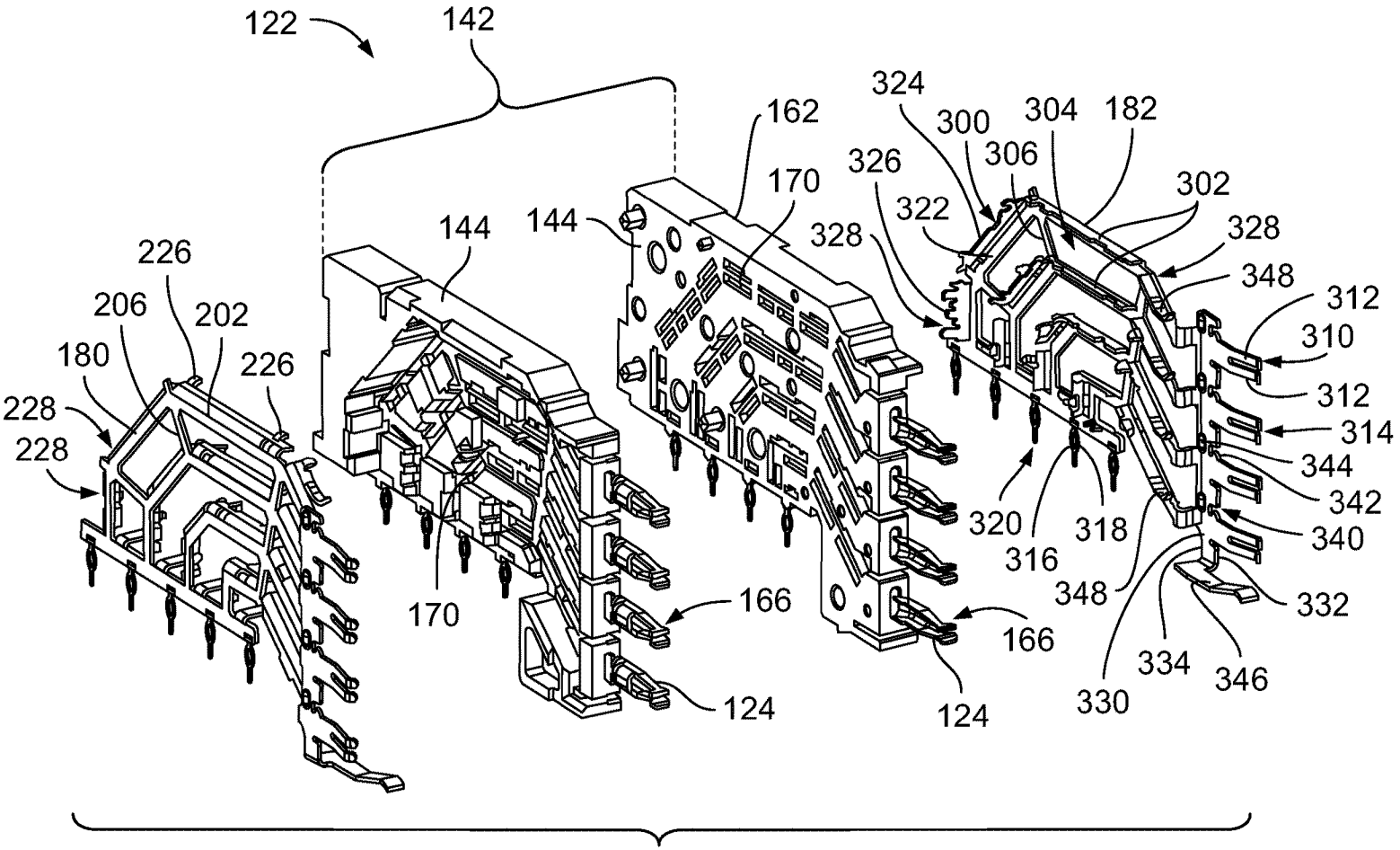
FIG. 5 is an exploded view of a contact module of the electrical connector in accordance with an exemplary embodiment.

FIG. 5 is an exploded view of the contact module 122 showing the first and second ground shields 180, 182 relative to the dielectric bodies 144 of the dielectric holder 142. The second ground shield 182 may be similar to the first ground shield 180. In an exemplary embodiment, the second ground shield 182 is stamped and formed from a stock piece of metal material. The second ground shield 182 includes a main body 300 configured to extend along the left side 162 of the dielectric holder 142. The main body 300 includes a plurality of left side rails 302 separated by gaps 304. The left side rails 302 are interconnected by struts 306 that span the gaps 304 between the rails 302.

The second ground shield 182 includes mating portions 310 defined by mating beams 312 at a mating end 314 of the main body 300. The mating portions 310 are configured to be mated with corresponding mating portions of the mating electrical connector (for example, the C-shaped mating ground shields 114, shown in FIG. 1). In an exemplary embodiment, the mating beams 312 extend along the left sides of the corresponding signal contacts 124. The mating beams 312 may be deflectable mating beams, such as spring beams. Optionally, the mating beams 312 are configured to be received inside the corresponding C-shaped mating ground shields 114 of the mating electrical connector 106. Alternatively, the mating beams 312 are configured to extend along the outside of the corresponding C-shaped mating ground shields 114 of the mating electrical connector.

The second ground shield 182 includes mounting portions 316 defined by compliant pins 318 at a mounting end 320 of the main body 300. The mounting portions 316 are configured to be terminated to the circuit board 104 (shown in FIG. 1). For example, the mounting portions 316 are configured to be received in plated vias in the circuit board 104.

The left side rails 302 are configured to provide shielding around corresponding signal contacts 124 (shown in FIG. 2). For example, in an exemplary embodiment, the left side rails 302 have side strips 322 configured to extend along the left side 162 of the dielectric holder 142, and connecting strips 324 configured to extend into the dielectric holder 142 and extend between adjacent signal contacts 124. The connecting strips 324 are bent perpendicular to and extend from the corresponding side strips 322. The left side rails 302 form right angle shielded spaces that receive corresponding signal contacts 124 to provide electrical shielding along the sides of the signal contacts 124 and between the signal contacts 124, such as above and/or below corresponding signal contacts 124. The struts 306 interconnect the left side rails 302 to hold the relative positions of the left side rails 302. The gaps 304 are defined between the left side rails 302 and generally follow the paths of the left side rails 302.

In an exemplary embodiment, each connecting strip 324 includes a commoning feature 326 for electrically connecting to the first ground shield 180 (shown in FIG. 4). In the illustrated embodiment, the commoning features 326 are commoning slots in the connecting strips 324 and commoning tabs; however, other types of commoning features may be used in alternative embodiments, such as channels, spring beams, clips, and the like. The commoning features 326 may be deflectable to engage and securely couple the second ground shield 182 to the first ground shield 180 when mated thereto.

The left side rails 302 are configured to extend along and follow the paths of the signal contacts 124, such as between the mating end 128 and the mounting end 130 (both shown in FIG. 1) of the electrical connector 102. For example, the left side rails 302 may transition from the mating end 314 to the mounting end 320 and have different segments or portions 328 that are angled relative to each other as the left side rails 302 transition between the ends 314, 320.

In an exemplary embodiment, each rail 202, 302 includes multiple commoning features 226, 326 to make periodic, reliable electrical connections therebetween. For example, each portion 228, 328 may include at least one commoning feature 226, 326. The commoning features 226, 326 may be generally spaced at approximately 3-5 mm apart to achieve good electrical performance in a desired range, such as between 30-40 GHz; however other spacings or other target ranges may be achieved in other embodiments.

When assembled, the ground shields 180, 182 form C-shaped hoods covering three sides of each pair of signal contacts 124. For example, the hoods cover both the right and left sides as well as the tops of the signal contacts 124 to shield the pair of signal contacts 124 from other pairs of signal contacts 124. The rails 202, 302 below the pair of signal contacts 124 shield the fourth side of the pair of signal contacts 124 such that the pair is shielded on all four sides. The first and second ground shields 180, 182 thus provide circumferential shielding around the pairs of signal contacts 124. The circumferential shielding is provided around each pair of signal contacts 124 for substantially the entire length of the transition portions 170 (shown in FIG. 2) of the signal contacts. The first and second ground shields 180, 182 provide shielding in all line-of-sight directions between all adjacent pairs of signal contacts 124, including pairs of signal contacts 124 in adjacent contact modules 122. Optionally, the bottom of the inner-most pair remains unshielded; however, the signal performance of the signal contacts 124 of the inner-most pair remains largely unaffected by having the one side unshielded. Optionally, a shield may be provided at the unshielded side of the inner-most pair.

In an exemplary embodiment, the second ground shield 182 includes a second side plate 330 forward of the left side rails 302. The mating portions 310 extend from the second side plate 330. The second side plate 330 is continuous top to bottom and holds the positions of the left side rails 302 with the struts 306. The second side plate 330 forms continuous shielding along the left sides of the signal contacts 124. The second side plate 330 extends between a front 332 and a rear 334. The mounting portions 310 extend forward from the front 332. The left side rails 302 extend from the rear 334. Optionally, the second side plate 330 may be out of plane with the left side rails 302, such as outward of the side strips 322 and the connecting strips 324.

The second side plate 330 includes slots 340 having guide features 342. The slots 340 receive corresponding ground blades 184 (shown in FIG. 3). The guide features 342 engage the ground blades 184 to locate the ground blades 184 relative to the first ground shield 182. For example, the guide features 342 may vertically positioned in the ground blade 184 in the slot 340. In an exemplary embodiment, the guide features 342 are defined by edges of the slot 340. The guide features 342 may include protrusions or tabs positioned in the slot 340 for locating the ground blade 184.

The second side plate 330 includes embossments 344 that extend outward therefrom. The embossments 344 are configured to engage the ground blades 184. The embossments 344 define points of contact with the ground blades 184. The embossments 344 may engage the ground blades 184 by an interference fit. For example, the mating fingers 192 (shown in FIG. 3) may engage the embossments 344 to mechanically and electrically connect the ground blades 184 to the second side plate 330.

The second ground shield 182 includes a lower ground beam 346 at the bottom of the second side plate 330. The lower ground beam 346 is bent perpendicular to the second side plate 330. The lower ground beam 346 is configured to be located below the mating portions 166 of the signal contacts 124 to provide electrical shielding below the bottom signal contact 124. The lower ground beam 346 may be electrically connected to the mating electrical connector 106 when mated thereto.

In an exemplary embodiment, the second ground shield 182 includes commoning features 348 extending from the left side rails 302. The commoning features 348 are configured to electrically engage the ground blades 184. In the illustrated embodiment, the commoning features 348 are deflectable spring beams extending from the front ends of the connecting strips 324. The commoning features 348 are configured to electrically connect to the mounting tabs 189 of the ground blades 184 to electrically common the second ground shield 182 and the ground blades 184.

Figure 6:
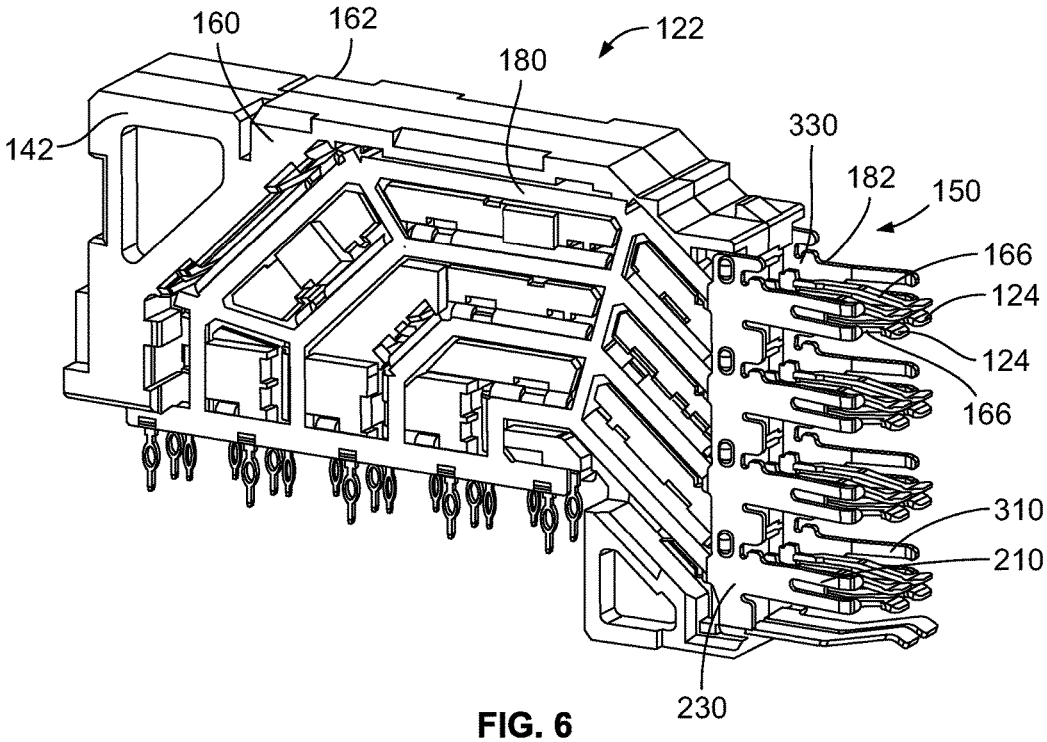
FIG. 6 is a perspective view of the contact module in an assembled state in accordance with an exemplary embodiment.

FIG. 6 is a perspective view of the contact module 122 in an assembled state showing the first and second ground shields 180, 182 coupled to the dielectric holder 142. The first and second ground shields 180, 182 are received in channels in the dielectric holder 142. The first and second side plates 230, 330 are located along the right and left sides of the dielectric holder 142 at the mating end 150. Portions of the first and second side plates 230, 330 extend along the right and left sides 160, 162, respectively. Portions of the first and second side plates 230, 330 extend forward of the mating end 150 along the mating portions 166 of the signal contacts 124. The first and second side plates 230, 330 form continuous shield walls from the top to the bottom of the contact module 122 forward of the mating end 150. The continuous shield walls provide electrical shielding for the mating portions 166 where the mating portions 166 extend from the mating end 150 of the dielectric holder 142. The mating portions 210, 310 of the first and second ground shields 180, 182 extend forward of the first and second side plates 230, 330 along the mating portions 166 of the signal contacts 124 to make electrical connection with the mating ground shield 114 (shown in FIG. 1).

Figure 7:
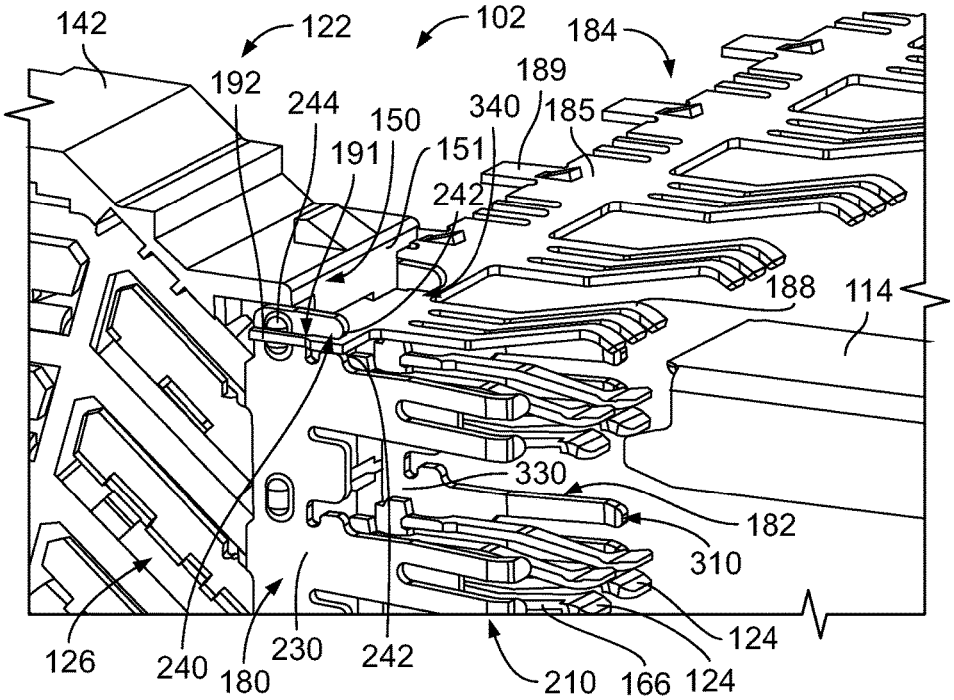
FIG. 7 is a perspective view of a portion of the electrical connector in accordance with an exemplary embodiment.

FIG. 7 is a perspective view of a portion of the electrical connector 102 showing one of the contact modules 122 and one of the ground blades 184 coupled to the contact module 122. FIG. 7 illustrates one of the mating ground shields 114 poised for mating with the shield structure 126. The ground blade 184 is coupled to the dielectric holder 142 and the first and second ground shields 180, 182. The mounting tab 189 is loaded into a corresponding slot at the front 151 of the dielectric holder 142.

The ground blade 184 is received in the slots 240, 340. The guide features 242, 342 position the ground blade 184 in the slots 240, 340. The guide features 242, 342 may have lead-ins to guide the ground blade 184 into the slots 240, 340. The first and second ground shields 180, 182 are received in corresponding slots 191 and the ground blade 184. The mating fingers 192 extend along the first and second side plates 230, 330 to engage the embossments 244, 344. The mating fingers 192 may engage the embossments 244, 344 by an interference fit.

When assembled, the ground blade 184 and the ground shields 180, 182 provide electrical shielding for the mating portions 166 of the signal contacts 124. The main body 185 of the ground blade 184 forms a continuous horizontal wall structure forward of the front 151 of the dielectric holder 142 between the first and second side plates 230, 330. The first and second side plates 230, 330 form continuous vertical wall structures forward of the front 151 of the dielectric holder 142. When another ground blade 184 is positioned below the signal contacts 124, a rectangular shield pocket is formed providing electrical shielding on all four sides of the pair of signal contacts 124 immediately forward of the mating end 150 of the dielectric holder 142 in the mating zone where the mating portions 166 of the signal contacts 124 transition out of the dielectric holder 142. The mating portions 188, 210, 310 are configured to interface with the mating ground shield 114 to provide electrical shielding around the mating portions 166 of the signal contacts 124.

Figure 8:
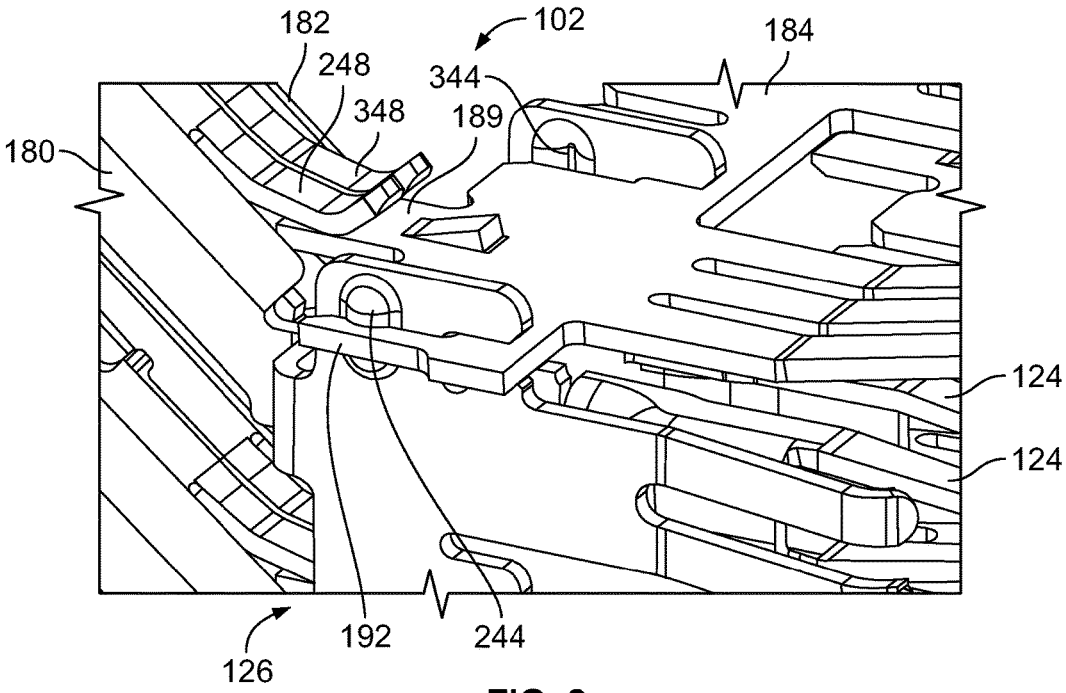
FIG. 8 is a perspective view of a portion of the electrical connector in accordance with an exemplary embodiment.

FIG. 8 is a perspective view of a portion of the electrical connector 102 showing the shield structure 126 relative to the signal contacts 124. The dielectric holder 142 and the housing 120 are removed to illustrate the interconnection between the ground blade 184 and the first and second ground shields 180, 182. The mounting tab 189 is configured to extend into the dielectric holder 142. The commoning features 248, 348 of the first and second ground shields 180, 182 electrically engage the mounting tab 189 of the ground blade 184. The mating fingers 192 engage the embossments 244, 344 to electrically connect the ground blade 184 to the first and second ground shields 180, 182.

Figure 9:
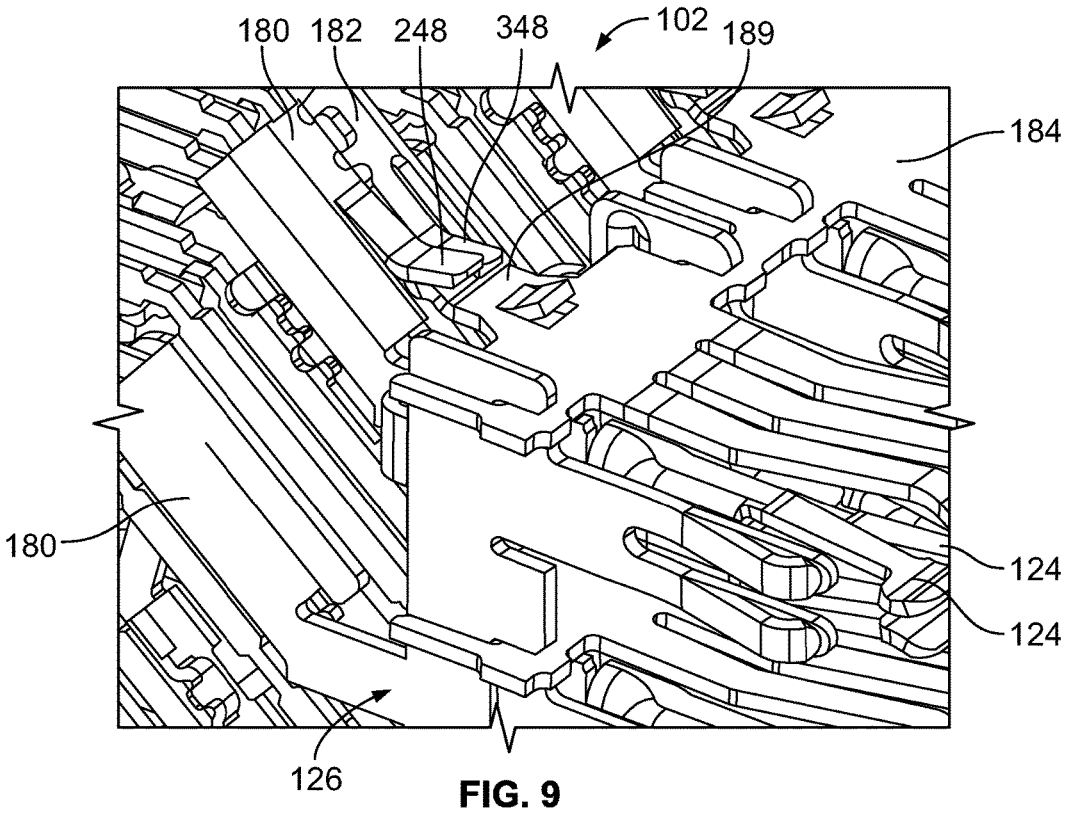
FIG. 9 is a perspective view of a portion of the electrical connector in accordance with an exemplary embodiment.

FIG. 9 is a perspective view of a portion of the electrical connector 102 showing the shield structure 126 relative to the signal contacts 124. The dielectric holder 142 and the housing 120 are removed to illustrate the interconnection between the ground blade 184 and the first and second ground shields 180, 182. The mounting tab 189 and the commoning features 248, 348 illustrated in FIG. 9 have a different shape than shown in FIG. 8. For example, the mounting tab 189 is nonplanar and has a step that is stepped upward to meet the commoning features 248, 348. The commoning features 248, 348 are bent to meet the mounting tab 189 and are not flexed outward as far as shown in FIG. 8, reducing the size of any gaps or openings in the shield structure 126.

Figure 10:
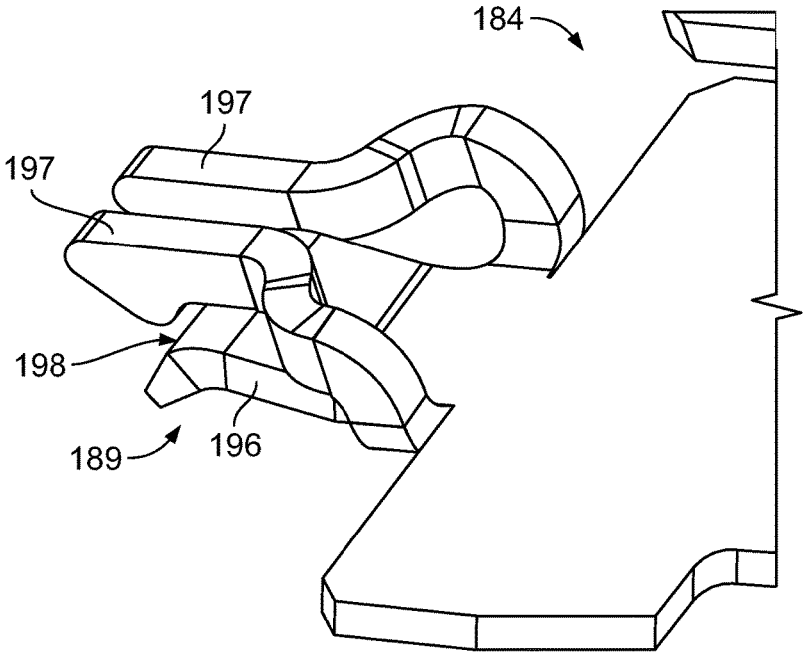
FIG. 10 is a perspective view of a portion of a ground blade in accordance with an exemplary embodiment.

FIG. 10 is a perspective view of a portion of the ground blade 184 in accordance with an exemplary embodiment. FIG. 10 illustrates the mounting tab 189 having a lower tab 196 and upper mating fingers 197. A gap 198 is formed between the lower tab 196 and the upper mating fingers 197. The gap 198 is configured to receive the commoning features 248, 348.

Figure 11:
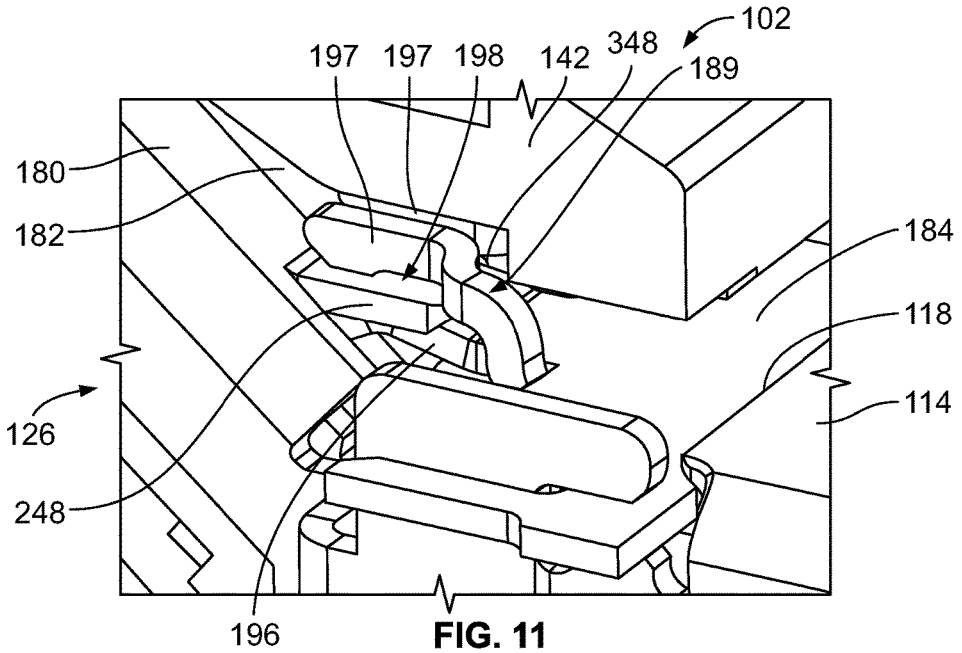
FIG. 11 is a perspective view of a portion of the electrical connector in accordance with an exemplary embodiment.

FIG. 11 is a perspective view of a portion of the electrical connector 102 showing the shield structure 126 relative to the signal contacts 124. The housing 120 is removed to illustrate the interconnection between the ground blade 184 and the first and second ground shields 180, 182 as well as the mating ground contact 114 relative to the shield structure 126. For example, the edge 118 of the mating ground contact 114 may be located adjacent, and may abut or engage, the ground blade 184 and/or the ground shields 180, 182. The mounting tab 189 is shown including the lower tab 196 and the upper mating fingers 197 shown in FIG. 10. The commoning features 248, 348 are shown received in the gap 198. The upper mating fingers 197 and/or the lower tab 196 are electrically connected to the commoning features 248, 348.

Figure 12:
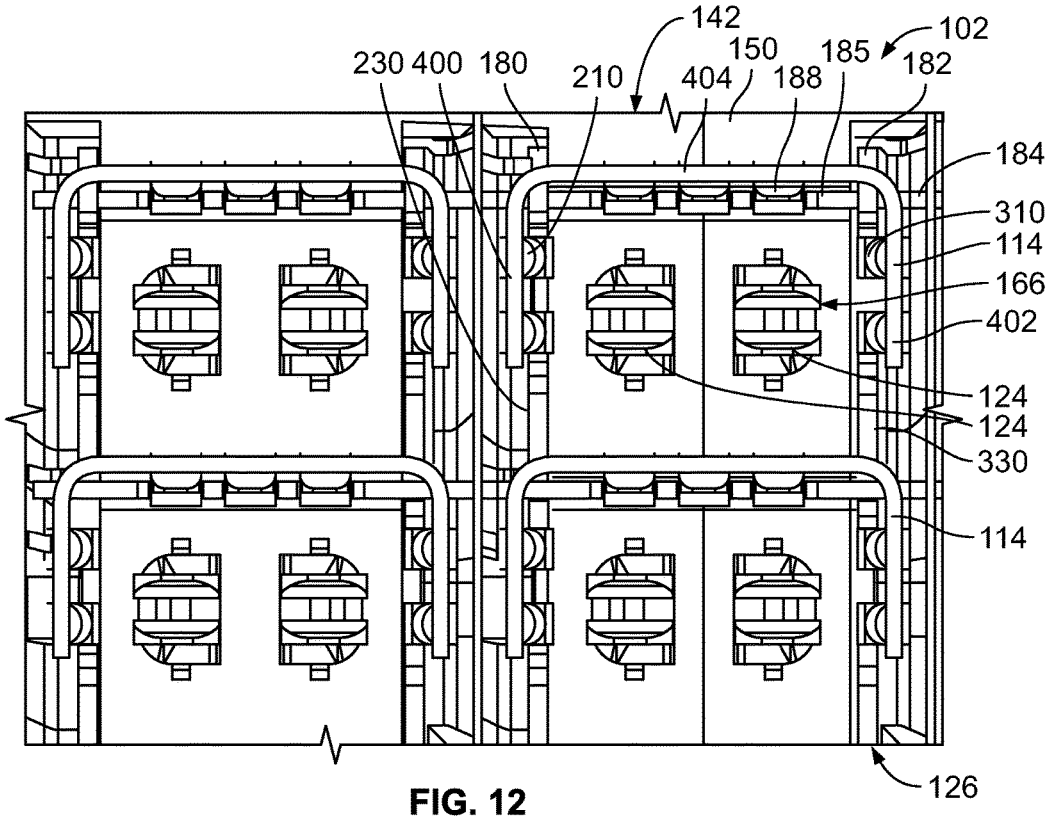
FIG. 12 is a front view of a mating interface of the electrical connector in accordance with an exemplary embodiment.

FIG. 12 is a front view of the mating interface of the electrical connector 102 showing the mating ground shields 114 relative to the shield structure 126. The first and second ground shields 180, 182 are provided along the right and left sides of the pairs of signal contacts 124. The ground blades 184 are shown above and below the pairs of signal contacts 124. The main body 185 of the ground blades 184 extends horizontally above the shield pockets surrounding the corresponding pairs of signal contacts 124. The first and second side plates 230, 330 of the first and second ground shields 180, 182 extend vertically along the right and left sides of the shield pockets surrounding the corresponding pairs of signal contacts 124. The mating portions 188 of the ground blades 184 are aligned vertically above and/or below the corresponding pairs of signal contacts 124. The mating portions 210, 310 of the first and second ground shields 180, 182 are horizontally aligned in the row with the corresponding pairs of signal contacts 124.

The mating ground shields 114 are coupled to the shield structure 126. The mating portions 188, 210, 310 engage the mating ground shields 114. The mating beams defining the mating portions 188, 210, 310 are spring biased against the interior surfaces of the walls of the mating ground shields 114. Each mating ground shield 114 includes a first side wall 400, a second side wall 402 and a center wall 404 between the first and second side walls 400, 402. The mating portions 188 of the ground blade 184 engage the center wall 404. The mating portions 210 of the first ground shield 180 engage the first side wall 400. The mating portions 310 of the second ground shield 182 engage the second side wall 402. The side walls 400, 402 and the center wall 404 form continuous shield walls around three sides of the shield pocket for the corresponding pair of signal contacts 124. The center wall 404 of the mating ground shield 114 below the shield pocket forms a continuous wall around the fourth side of the shield pocket. Beyond the edge of the mating ground shield 114, the main body 185 of the ground blade 184 and the first and second side plates 230, 330 of the first and second ground shields 180, 182 form continuous walls around all 4 sides of the pair of signal contacts at the front 151 of the dielectric holder 142. As such, the shield structure 126 and the mating ground shields 114 provide effective electrical shielding for the pairs of signal contacts 124. The mating portions 166 are thus electrically shielded at the mating zone. The circumferential shielding is provided above, below and along opposite sides of each pair of signal contacts 124 at the mating end 150 of the dielectric holder 142. The circumferential shielding not only extends along the length of the transition portions 170 of the signal contacts 124, but is also located immediately forward of the dielectric holder 142, such as between the mating ground contacts 114 and the dielectric holder 142.

The stamped and formed first and second ground shields 180, 182 and the ground blade 184 are cost effective to manufacture, as compared to conventional plated plastic conductive holders. The stamped and formed first and second ground shields 180, 182 and the ground blade 184 provide electrical shielding in all directions for each pair-in-row pair of signal contacts 124, as compared to conventional ground shields that only extend along the sides of the signal contacts and not above or below the pair of signal contacts.

FIG. 13 is a front perspective view of an electrical connector 502 formed in accordance with an exemplary embodiment. The electrical connector 502 is similar to the electrical connector 102; however, the electrical connector 502 is a pair-in-column connector as opposed to the pair-in-row electrical connector 102 of the electrical connector system 100. The shielding structure 526 of the electrical connector 502 is similar to the shielding structure 126 of the electrical connector 102; however, shapes and orientations of some of the components of the shielding structure 526 may differ from the pair-in-row embodiment.

The electrical connector 502 includes a housing 520 that holds a plurality of contact modules 522. The contact modules 522 each include a plurality of signal contacts 524 (shown in FIG. 14) that define signal paths through the electrical connector 502. In an exemplary embodiment, each contact module 522 has a shield structure 526 for providing electrical shielding for the signal contacts 524. The electrical connector 502 includes a mating end 528, such as at a front of the electrical connector 502, and a mounting end 530, such as at a bottom of the electrical connector 502. The signal contacts 524 are arranged in pairs and the pairs are arranged in columns (pair-in-column signal contacts).

Figure 14:
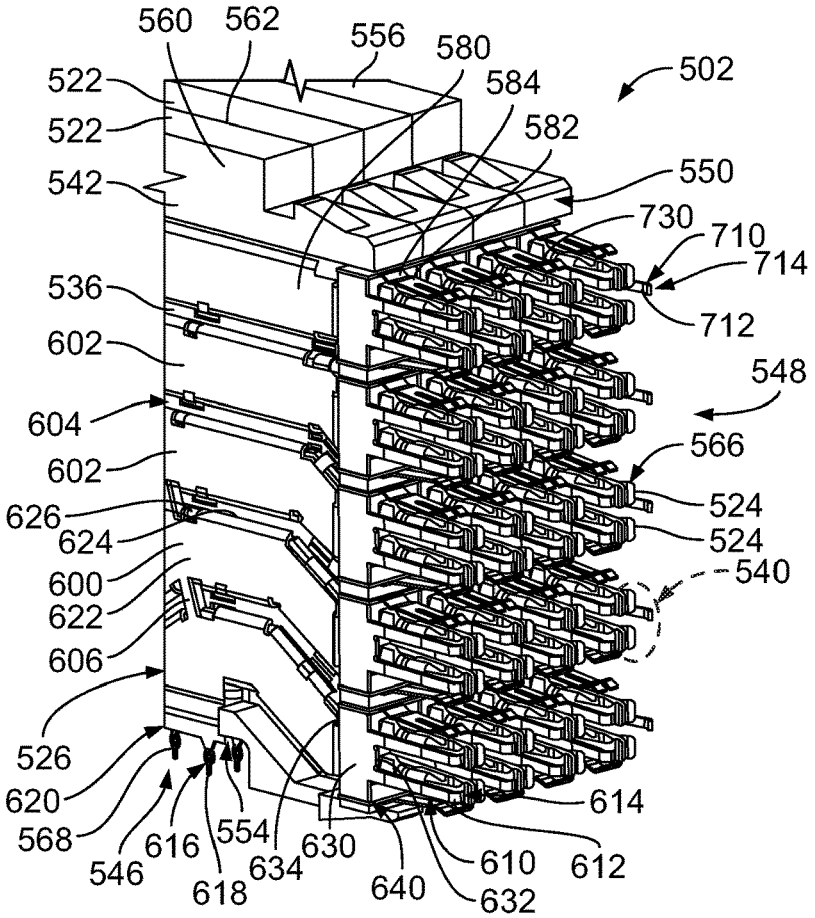
FIG. 14 is a perspective view of a portion of the electrical connector.
Figure 15:
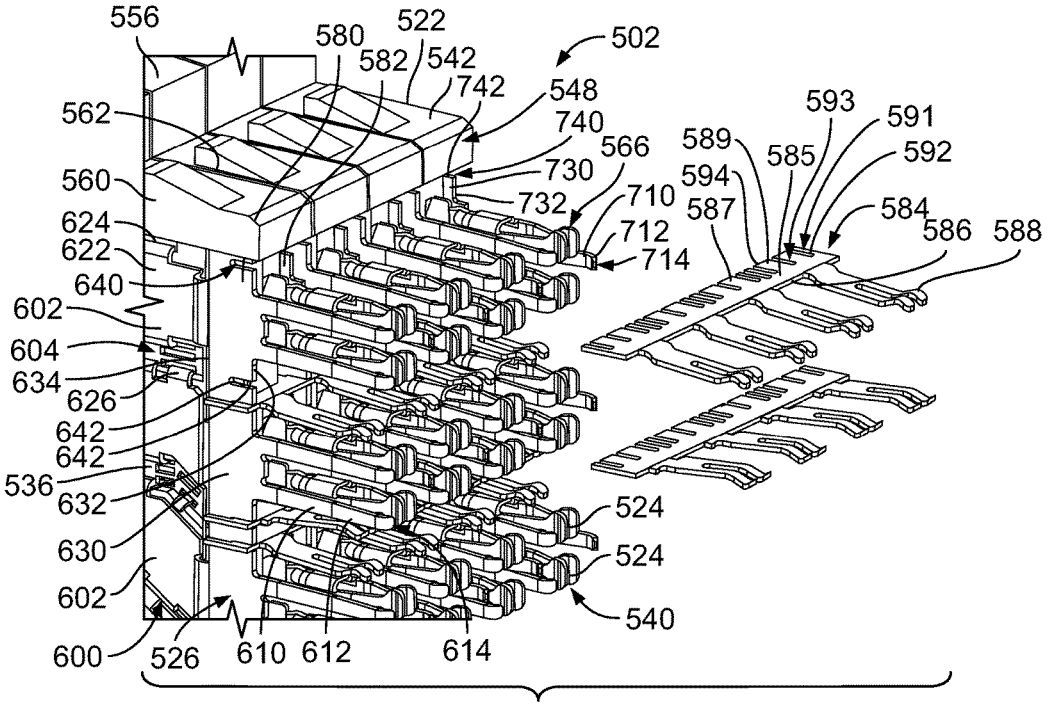
FIG. 15 is a partially exploded, perspective view of a portion of the electrical connector in accordance with an exemplary embodiment.
Figure 16:
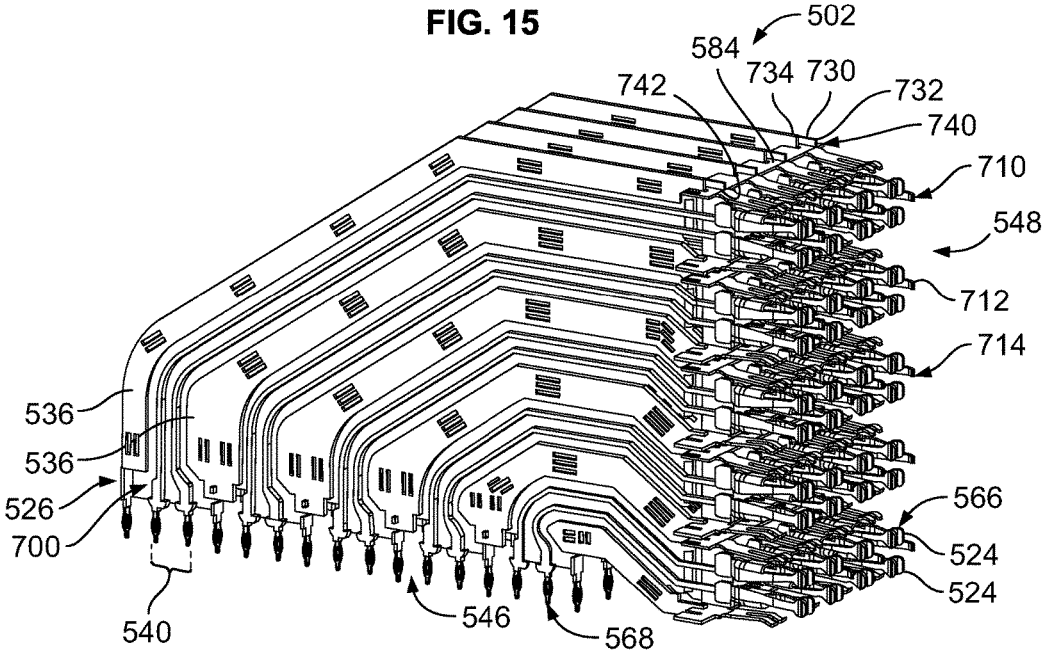
FIG. 16 is a perspective view of a portion of the electrical connector in accordance with an exemplary embodiment.

FIG. 14 is a perspective view of a portion of the electrical connector 502 with the housing 520 removed to illustrate the contact modules 522. FIG. 15 is a partially exploded, perspective view of a portion of the electrical connector 502 showing one of the ground blades poised for coupling to the contact modules 522. FIG. 16 is a perspective view of a portion of the electrical connector 502 showing portions of the contact modules 522 removed to illustrate the signal contacts 524. The signal contacts 524 are arranged in an array with ground contacts or guard traces 536 (FIG. 16). The guard traces 536 are arranged between corresponding signal contacts 524, such as between pairs 540 of the signal contacts 524. The guard traces 536 form part of the shield structure 526. The guard traces 536 provide electrical shielding between the signal contacts 524, such as between the pairs 540 of the signal contacts 524. In an exemplary embodiment, the signal contacts 524 and the guard traces 536 are stamped and formed from a common sheet of metal, such as a leadframe.

The contact module 522 includes a frame assembly having the signal contacts 524 and the guard traces 536 with a dielectric frame or holder 542 (FIG. 14) holding the signal contacts 524 and the guard traces 536. The dielectric holder 542 generally surrounds the signal contacts 524 and the guard traces 536 along substantially the entire lengths thereof between a mounting end 546 at the bottom and a mating end 548 at the front. The shield structure 526 is held by and/or configured to be coupled to the dielectric holder 542 to provide electrical shielding for the signal contacts 524. The shield structure 526 provides circumferential shielding for each pair 540 of signal contacts 524 along at least a majority of a length of the signal contacts 524, such as substantially an entire length of the signal contacts 524.

The dielectric holder 542 has a mating end 550 at a front configured to be loaded into the housing 520 (shown in FIG. 13), a rear 552 opposite the mating end 550, a mounting end 554 at a bottom, which optionally may be mounted to a circuit board (not shown), and a top 556 generally opposite the mounting end 554. The dielectric holder 542 also includes first and second sides 560, 562, such as a right side 560 and a left side 562.

Each signal contact 524 has a mating portion 566 extending forward from the mating end 550 of the dielectric holder 542 and a mounting portion 568 extending downward from the mounting end 554. Each signal contact 524 has a transition portion between the mating and mounting portions 566, 568.

In an exemplary embodiment, the shield structure 526 includes first and second ground shields 580, 582 and ground blades 584 extending between and configured to be electrically connected to the first and second ground shields 580, 582 (FIG. 16 only illustrates the second ground shields 582). The first and second ground shields 580, 582 and the ground blades 584 are each separate stamped and formed pieces configured to be mechanically and electrically connected together to form part of the shield structure 526. The first and second ground shields 580, 582 and/or the ground blades 584 are configured to be electrically connected to the guard traces 536 to electrically common all of the components of the shield structure 526. The first and second ground shields 580, 582 and the ground blades 584 cooperate to provide circumferential shielding for each pair 540 of signal contacts 524 at the mating end 548. When assembled, the first ground shield 580 is positioned along the right side 560 of the dielectric holder 542 and the second ground shield 582 is positioned along the left side 562 of the dielectric holder 542, while the ground blades 584 are provided at the mating end 550 of the dielectric holder 542 and extend along each of the contact modules 522 to electrically connect each of the first and second ground shields 580, 582. The ground blades 584 and the first and second ground shields 580, 582 electrically connect the contact module 522 to the mating electrical connector, such as to the mating ground shields thereof.

With reference to FIG. 15, the ground blade 584 includes a main body 585 having a front 586 and a rear 587. The ground blade 584 includes a plurality of mating portions 588 extending forward from the front 586. In the illustrated embodiment, the mating portions 588 are arranged in sets, with each set configured to mate with a corresponding mating ground shield. Each set includes a plurality of mating portions 588, thus defining multiple points of contact with the mating ground shield. The mating portions 588 are deflectable mating beams configured to be spring biased against the mating ground shield when mated thereto to create a mechanical and electrical connection with the mating ground shield. Optionally, the mating portions 588 are configured to be received inside the corresponding C-shaped mating ground shields of the mating electrical connector. Alternatively, the mating portions 588 are configured to extend along the outside of the corresponding C-shaped mating ground shields of the mating electrical connector.

The ground blade 584 includes mounting tabs 589 at the rear 587 used for mounting the ground blade 584 to the dielectric holder 542. Optionally, the ground blade 584 may include a securing feature (not shown) for securing the ground blade 584 to the dielectric holder 542.

The ground blade 584 includes slots 591 that receive the first and second ground shields 580, 582 during mating thereto. In an exemplary embodiment, the ground blade 584 includes mating fingers 592 extending along the slots 591. The mating fingers 592 are configured to be mated to the corresponding ground shield 580, 582. Optionally, the mating fingers 592 may be deflectable. The mating fingers 592 may include a bulge or protrusion extending into the slot 591 that defines a mating interface for mating with the corresponding ground shield 580, 582.

The ground blade 584 includes guard trace slots 593 that receive corresponding guard traces 536 when assembled. In an exemplary embodiment, the ground blade 584 includes mating fingers 594 extending along the guard trace slots 593. The mating fingers 594 are configured to be mated to the corresponding guard traces 536. Optionally, the mating fingers 592 may be deflectable. The mating fingers 592 may include a bulge or protrusion extending into the guard trace slot 593 that defines a mating interface for mating with the corresponding guard trace 536.

Wither additional reference back to FIGS. 14 and 16, the first ground shield 580 is stamped and formed from a stock piece of metal material. In an exemplary embodiment, the first ground shield 580 includes a main body 600 configured to extend along the right side 560 of the dielectric holder 542 (although the ground shield 580 may be reversed and designed to extend along the left side 562 in other various embodiments). The main body 600 includes a plurality of rails 602 separated by gaps 604, the rails 602 being interconnected by struts 606 that span the gaps 604 between the rails 602. The rails 602 are configured to extend along and follow the paths of the signal contacts 524.

The first ground shield 580 includes mating portions 610 defined by mating beams 612 at a mating end 614 of the main body 600. The mating portions 610 are configured to be mated with corresponding mating portions of the mating electrical connector (for example, the C-shaped mating ground shields). The mating beams 612 extend along the sides of the mating portions 566 of corresponding signal contacts 524.

The first ground shield 580 includes mounting portions 616 defined by compliant pins 618 at a mounting end 620 of the main body 600. The mounting portions 616 are configured to be terminated to the circuit board. For example, the mounting portions 616 are configured to be received in plated vias in the circuit board.

The rails 602 are configured to provide shielding along the sides of the signal contacts 524 of the corresponding pair 540. For example, in an exemplary embodiment, the rails 602 have side strips 622 configured to extend along the right side 560 of the dielectric holder 542 and connecting strips 624 configured to extend into the dielectric holder 542 and extend between adjacent pairs 540 of the signal contacts 524. The connecting strips 624 extend into the dielectric holder 542 to directly engage the guard traces 536. The side strips 622 generally follow the paths of the transition portions of the signal contacts 524. The side strips 622 provide shielding along the sides of the pair 540 of signal contacts 524. In an exemplary embodiment, each connecting strip 624 includes one or more commoning features 626 for electrically connecting the first ground shield 580 to the guard traces 536. In the illustrated embodiment, the commoning features 626 are commoning tabs, and may be referred to hereinafter as commoning tabs 626, which extend outward from the connecting strips 624; however, other types of commoning features may be used in alternative embodiments, such as channels, slots, spring beams, and the like.

In an exemplary embodiment, the first ground shield 580 includes a first side plate 630 forward of the right side rails 602. The mating portions 610 extend from the first side plate 630. The first side plate 630 is continuous top to bottom. The first side plate 630 forms continuous shielding along the right sides of the signal contacts 524. The first side plate 630 extends between a front 632 and a rear 634. The mating portions 610 extend forward from the front 632. The right side rails 602 extend from the rear 634.

The first side plate 630 includes slots 640 having guide features 642. The slots 640 receive corresponding ground blades 584. The guide features 642 engage the ground blades 584 to locate the ground blades 584 relative to the first ground shield 580. For example, the guide features 642 may vertically position the ground blade 584 in the slot 640. In an exemplary embodiment, the guide features 642 are defined by edges of the slot 640. The guide features 642 may include protrusions or tabs positioned in the slot 640 for locating the ground blade 584.

The second ground shield 582 is stamped and formed from a stock piece of metal material. The second ground shield may be similar to the first ground shield 580 and include similar components. The second ground shield 582 includes a main body 700 configured to extend along the left side 562 of the dielectric holder 542.

The second ground shield 582 includes mating portions 710 defined by mating beams 712 at a mating end 714 of the main body 700. The mating portions 710 are configured to be mated with corresponding mating portions of the mating electrical connector (for example, the C-shaped mating ground shields). In an exemplary embodiment, the mating beams 712 extend along the left sides of the corresponding signal contacts 524. The mating beams 712 may be deflectable mating beams, such as spring beams.

In an exemplary embodiment, the second ground shield 582 includes a second side plate 730. The mating portions 710 extend from the second side plate 730. The second side plate 730 is continuous top to bottom. The second side plate 730 forms continuous shielding along the left sides of the signal contacts 524. The second side plate 730 extends between a front 732 and a rear 734. The mounting portions 710 extend forward from the front 732.

The second side plate 730 includes slots 740 having guide features 742. The slots 740 receive corresponding ground blades 584. The guide features 742 engage the ground blades 584 to locate the ground blades 584 relative to the first ground shield 582. For example, the guide features 742 may vertically positioned in the ground blade 584 in the slot 740. In an exemplary embodiment, the guide features 742 are defined by edges of the slot 740. The guide features 742 may include protrusions or tabs positioned in the slot 740 for locating the ground blade 584.

Figure 17:
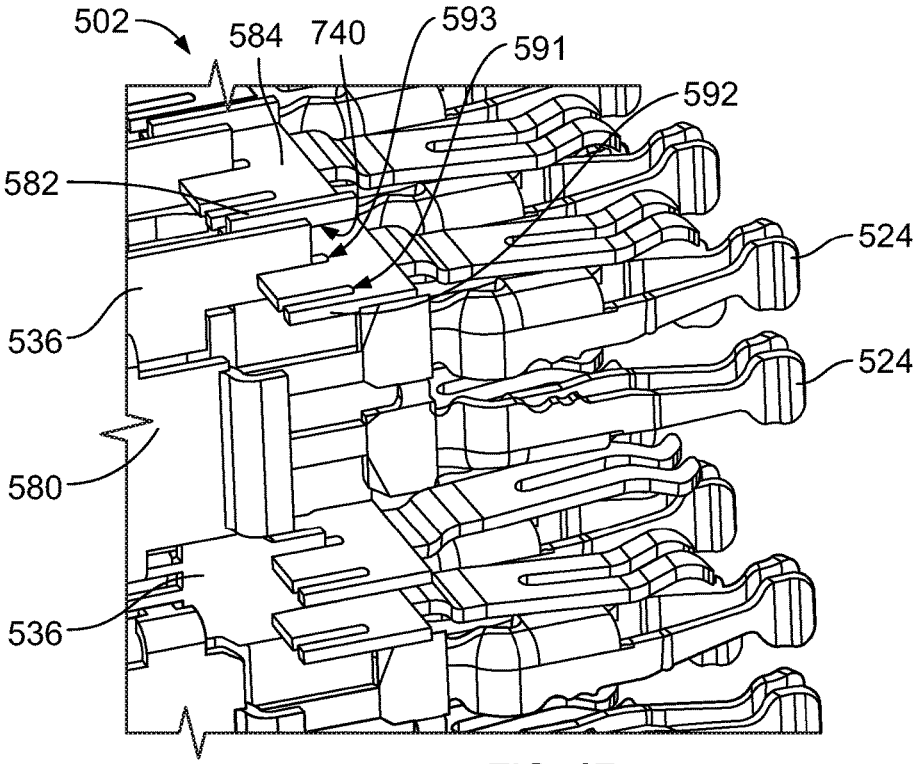
FIG. 17 is a perspective view of a portion of the electrical connector in accordance with an exemplary embodiment.

FIG. 17 is a perspective view of a portion of the electrical connector 502 in accordance with an exemplary embodiment. The housing 520 and the dielectric bodies 544 are removed to illustrate the ground blades 584, the signal contacts 524 and the guard traces 536. Portions of the first ground shields 580 have been removed to illustrate the signal contacts 524 and the guard traces 536. The ground blades 584 are positioned above and below the pairs of signal contacts 524. The ground blades 584 provide electrical shielding between the pairs of signal contacts 524 within the same contact module 522.

When assembled, the slots 740, 640 (FIG. 15) in the ground shields 580, 582 receive the ground blades 584. The slots 591 in the ground blades 584 receive the corresponding ground shields 580, 582. The mating fingers 592 engage the ground shields 580, 582 to electrically connect the ground blades 584 to the ground shields 580, 582. The mating fingers 592 may be deflectable against the ground shields 580, 582. The guard trace slots 593 in the ground blades 584 receive the corresponding guard traces 536 to electrically connect the ground blades 584 to the guard traces 536.

Figure 18:
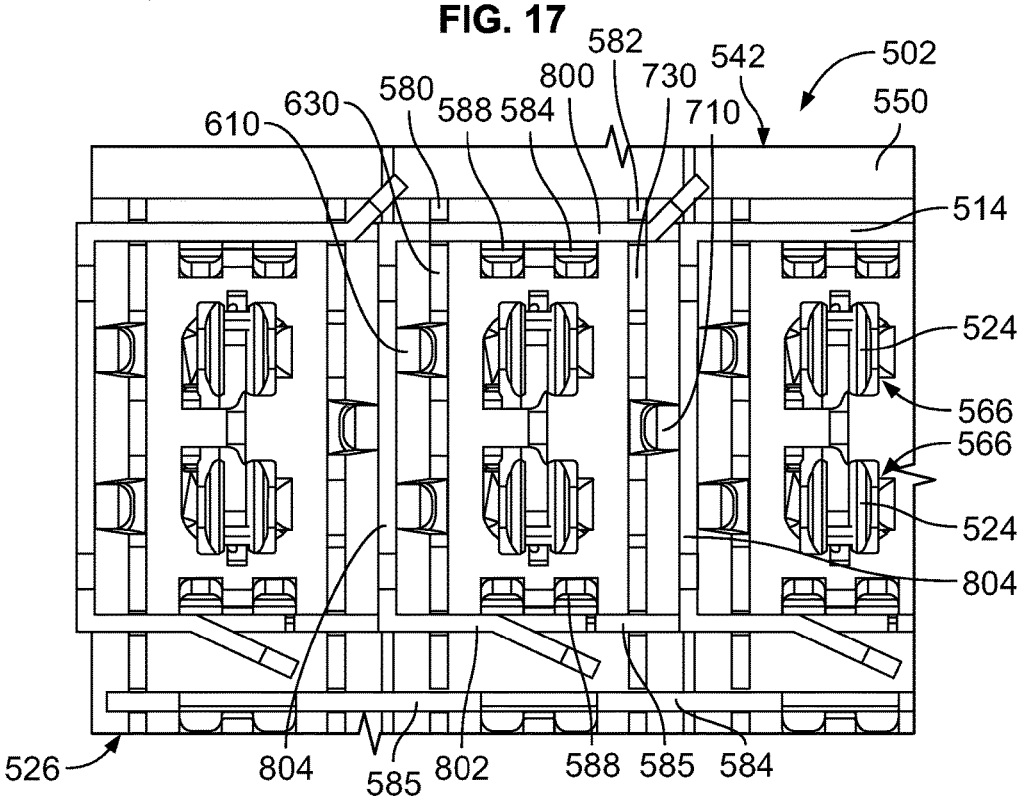
FIG. 18 is a front view of a mating interface of the electrical connector in accordance with an exemplary embodiment.

FIG. 18 is a front view of the mating interface of the electrical connector 502 showing mating ground shields 514 relative to the shield structure 526. The signal contacts 524 are arranged in pairs within the same column and are thus stacked vertically. The first and second ground shields 580, 582 are provided along the right and left sides of the pairs of signal contacts 524. The ground blades 584 are shown above and below the pairs of signal contacts 524. The main body 585 of the ground blades 584 extends horizontally above the shield pockets surrounding the corresponding pairs of signal contacts 524. The first and second side plates 630, 730 of the first and second ground shields 580, 582 extend vertically along the right and left sides of the shield pockets surrounding the corresponding pairs of signal contacts 524. The mating portions 588 of the ground blades 584 are aligned vertically above and/or below the corresponding pairs of signal contacts 524. The mating portions 610, 710 of the first and second ground shields 580, 582 are aligned in the row with the corresponding pairs of signal contacts 524.

The mating ground shields 514 are coupled to the shield structure 526. The mating portions 588, 610, 710 engage the mating ground shields 514. The mating beams defining the mating portions 588, 610, 710 are spring biased against the surfaces of the walls of the mating ground shields 514. Each mating ground shield 514 includes a first end wall 800, a second end wall 802 and a center wall 804 between the first and second end walls 800, 802. The mating portions 588 of the ground blade 584 engage the first and second end walls 800, 802. The mating portions 610 of the first ground shield 580 engage the center wall 804. The mating portions 710 of the second ground shield 582 engage the center wall 804 of the adjacent mating ground shield 514. The end walls 800, 802 and the center wall 804 form continuous shield walls around three sides of the shield pocket for the corresponding pair of signal contacts 524. The center wall 804 of the mating ground shield 514 adjacent to the shield pocket forms a continuous wall around the fourth side of the shield pocket. Beyond the edge of the mating ground shield 514, the main body 585 of the ground blade 584 and the first and second side plates 630, 730 of the first and second ground shields 580, 582 form continuous walls around all four sides of the pair of signal contacts at the front of the dielectric holder 542. As such, the shield structure 526 and the mating ground shields 514 provide effective electrical shielding for the pairs of signal contacts 524. The mating portions 566 are thus electrically shielded at the mating zone. The circumferential shielding is provided above, below and along opposite sides of each pair of signal contacts 524 at the mating end 550 of the dielectric holder 542. The circumferential shielding not only extends along the length of transition portions of the signal contacts 524, but is also located immediately forward of the dielectric holder 542, such as between the mating ground contacts 514 and the dielectric holder 542.

The stamped and formed first and second ground shields 580, 582 and the ground blade 584 are cost effective to manufacture, as compared to conventional plated plastic conductive holders. The stamped and formed first and second ground shields 580, 582 and the ground blade 584 provide electrical shielding in all directions for each pair-in-column pair of signal contacts 524, as compared to conventional ground shields that only extend along the sides of the signal contacts and not above or below the pair of signal contacts.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

What is claimed is:

1. A contact module comprising:

a dielectric holder having first and second sides extending between a mating end at a front of the dielectric holder and a mounting end;

signal contacts being held by the dielectric holder, the signal contacts having mating portions extending forward of the mating end, mounting portions extending from the mounting end for termination to a circuit board, and transition portions extending through the dielectric holder between the mating portion and the mounting portion; and a shield structure coupled to the dielectric holder and providing electrical shielding for the signal contacts, the shield structure having a first ground shield provided at the first side of the dielectric holder and a second ground shield provided at the second side of the dielectric holder, the first ground shield having mating portions extending forward of the mating end of the dielectric holder along first sides of the mating portions of the signal contacts and providing electrical shielding for the mating portions of the signal contacts, the second ground shield having mating portions extending forward of the mating end of the dielectric holder along second sides of the mating portions of the signal contacts and providing electrical shielding for the mating portions of the signal contacts, the shield structure having ground blades extending between the first and second ground shields, the ground blades having mating portions extending forward of the mating end of the dielectric holder at least one of above or below the mating portions of the signal contacts, the ground blades electrically connecting the mating portions of the first ground shield and the mating portions of the second ground shield immediately forward of the mating end of dielectric holder.

2. The contact module of claim 1, wherein the mating portions of the first ground shield are connected by a continuous first side plate extending between and electrically connecting each of the mating portions of the first ground shield, and wherein the mating portions of the second ground shield are connected by a continuous second side plate extending between and electrically connecting each of the mating portions of the second ground shield, each of the ground blades directly engaging the first side plate and the second side plate.

3. The contact module of claim 1, wherein the first and second ground shields vertically commons each of the mating portions of the first and second ground shields and the ground blades horizontally commons the first and second ground shields together.

4. The contact module of claim 1, wherein the ground blades are configured to be electrically connected to first and second ground shields of an adjacent contact module to electrically connect the shield structure to a shield structure of the adjacent contact module.

5. The contact module of claim 1, wherein the first ground shield includes a continuous first side plate extending between and electrically connecting each of the mating portions of the first ground shield, the mating portions of the first ground shield extending forward of the first side plate, wherein the second ground shield includes a continuous second side plate extending between and electrically connecting each of the mating portions of the second ground shield, the mating portions of the second ground shield extending forward of the second side plate, and wherein the ground blades include a main body extending between and electrically connected to the first and second side plates, the mating portions of the ground blades extending forward of the corresponding main body, the first and second side plates and the main bodies of the ground blades forming shield boxes extending along four sides of the corresponding signal contacts immediately forward of the mating end of the dielectric holder.

6. The contact module of claim 1, wherein the ground blades includes mounting tabs extending into the dielectric holder, the first and second ground shields including commoning features engaging and being electrically connected to the mounting tabs.

7. The contact module of claim 1, wherein the ground blades include mating slots defined by mating fingers, the mating slots receiving the first and second ground shields, the mating fingers engaging the corresponding first and second ground shields to electrically connect the ground blades to the first and second ground shields.

8. The contact module of claim 1, wherein the first and second ground shields include slots having guide features, the slots receiving the ground blades and the guide features engage the ground blades to locate the ground blades relative to the first and second ground shields.

9. The contact module of claim 1, wherein the first and second ground shields have embossments, the ground blades engaging the embossments in an interference fit to mechanically and electrically connect the ground blades to the first and second ground shields.

10. The contact module of claim 1, wherein each mating portion of the first ground shield includes a plurality of mating beams each having a respective mating interface configured to engage a corresponding ground shield of a mating electrical connector, wherein each mating portion of the second ground shield includes a plurality of mating beams each having a respective mating interface configured to engage the corresponding ground shield of the mating electrical connector, wherein each mating portion of the ground blades includes a plurality of mating beams each having a respective mating interface configured to engage the corresponding ground shield of the mating electrical connector.

11. The contact module of claim 1, wherein the ground blades are configured to be mounted onto the dielectric holder from the front of the dielectric holder after the first and second ground shields are assembled to the first and second sides of the dielectric holder, respectively.

12. The contact module of claim 1, wherein the signal contacts are arranged in pairs carrying differential signals, the ground blades and the first and second ground shields forming shield pockets providing circumferential shielding above, below and along opposite sides of each pair of signal contacts at the mating end of the dielectric holder.

13. The contact module of claim 1, wherein the ground blades electrically engage corresponding guard traces between corresponding signal contacts.

14. A shield structure for a contact module having a dielectric holder holding signal contacts arranged in pairs carrying differential signals, the signal contacts having mating portions extending forward of the dielectric holder for mating with a mating electrical connector, the shield structure comprising:

a first ground shield having a main body configured to extend along a first side of the dielectric holder, the main body having a plurality of rails separated by gaps, the rails having side strips configured to extend along the first side of the dielectric holder, the rails having connecting strips configured to extend into the dielectric holder, each rail having a mating portion extending from the main body forward of the dielectric holder for providing electrical shielding for the mating portions of the corresponding signal contacts;

a second ground shield having a main body configured to extend along a second side of the dielectric holder, the main body having a plurality of rails separated by gaps, the rails having side strips configured to extend along the second side of the dielectric holder, the rails having connecting strips configured to extend into the dielectric holder, each rail having a mating portion extending from the main body forward of the dielectric holder for providing electrical shielding for the mating portions of the corresponding signal contacts; and ground blades configured to at least partially cover a mating end of the dielectric holder, the ground blades extending between the first and second ground shields, the ground blades having mating portions extending forward of the dielectric holder at least one of above or below the mating portions of the signal contacts, the ground blades electrically connecting the mating portions of the first ground shield and the mating portions of the second ground shield immediately forward of the mating end of the dielectric holder.

15. The shield structure of claim 14, wherein the mating portions of the first ground shield are connected by a continuous first side plate extending between and electrically connecting each of the mating portions of the first ground shield, and wherein the mating portions of the second ground shield are connected by a continuous second side plate extending between and electrically connecting each of the mating portions of the second ground shield, each of the ground blades directly engaging the first side plate and the second side plate.

16. The shield structure of claim 14, wherein the first and second ground shields vertically commons each of the mating portions of the first and second ground shields and the ground blades horizontally commons the first and second ground shields together.

17. The shield structure of claim 14, wherein the ground blades are configured to be electrically connected to first and second ground shields of an adjacent contact module to electrically connect the shield structure to a shield structure of the adjacent contact module.

18. The shield structure of claim 14, wherein the first ground shield includes a continuous first side plate extending between and electrically connecting each of the mating portions of the first ground shield, the mating portions of the first ground shield extending forward of the first side plate, wherein the second ground shield includes a continuous second side plate extending between and electrically connecting each of the mating portions of the second ground shield, the mating portions of the second ground shield extending forward of the second side plate, and wherein the ground blades include a main body extending between and electrically connected to the first and second side plates, the mating portions of the ground blades extending forward of the corresponding main body, the first and second side plates and the main bodies of the ground blades forming shield boxes extending along four sides of the corresponding signal contacts immediately forward of the mating end of the dielectric holder.

19. An electrical connector comprising:

a housing having a mating end, contact modules arranged in a contact module stack received in and extending from the housing for termination to a circuit board;

wherein each contact module comprises:

a dielectric holder having first and second sides extending between a mating end and a mounting end;

signal contacts being held by the dielectric holder, the signal contacts having mating portions extending forward of the mating end, mounting portions extending from the mounting end for termination to a circuit board, and transition portions extending through the dielectric holder between the mating and mounting portions; and a shield structure coupled to the dielectric holder and providing electrical shielding for the signal contacts, the shield structure having a first ground shield provided at the first side of the dielectric holder and a second ground shield provided at the second side of the dielectric holder, the first ground shield having mating portions extending forward of the mating end of the dielectric holder along first sides of the mating portions of the signal contacts and providing electrical shielding for the mating portions of the signal contacts, the second ground shield having mating portions extending forward of the mating end of the dielectric holder along second sides of the mating portions of the signal contacts and providing electrical shielding for the mating portions of the signal contacts, the shield structure having ground blades extending across each of the contact modules to electrically connect the first and second ground shields of each of the contact modules, the ground blades having mating portions extending forward of the mating end of the dielectric holder at least one of above or below the mating portions of the signal contacts, the ground blades electrically connecting the mating portions of the first ground shield and the mating portions of the second ground shield immediately forward of the mating end of dielectric holder.

20. The electrical connector of claim 19, wherein the mating portions of the first ground shield are connected by a continuous first side plate extending between and electrically connecting each of the mating portions of the first ground shield, and wherein the mating portions of the second ground shield are connected by a continuous second side plate extending between and electrically connecting each of the mating portions of the second ground shield, each of the ground blades directly engaging the first side plate and the second side plate.

* * * * *